US008016735B2

(12) United States Patent
Wetsch et al.

(10) Patent No.: US 8,016,735 B2
(45) **Date of Patent: *Sep. 13, 2011**

(54) APPARATUS FOR CRUMPLING PAPER SUBSTRATES

(75) Inventors: Thomas Wetsch, St. Charles, IL (US); Robert Tegel, Huntley, IL (US)

(73) Assignee: Pregis Innovative Packaging, Inc., Deerfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/824,932

(22) Filed: Jun. 28, 2010

(65) Prior Publication Data

US 2010/0331161 A1 Dec. 30, 2010

Related U.S. Application Data

(63) Continuation of application No. 12/008,166, filed on Jan. 9, 2008, now Pat. No. 7,771,338, which is a continuation-in-part of application No. 11/811,862, filed on Jun. 12, 2007, now Pat. No. 7,744,519.

(60) Provisional application No. 60/844,565, filed on Sep. 14, 2006, provisional application No. 60/853,585, filed on Oct. 23, 2006, provisional application No. 60/906,761, filed on Mar. 12, 2007.

(51) Int. Cl.
*B31B 1/00* (2006.01)

(52) U.S. Cl. ..... 493/464; 493/967

(58) Field of Classification Search ..... 493/352, 493/459, 461, 462, 464, 967, 435, 434, 442, 493/454, 346; 100/161, 176

See application file for complete search history.

(56) References Cited

U.S. PATENT DOCUMENTS

| | | | | |
|---|---|---|---|---|
| 3,425,888 | A * | 2/1969 | Kellicutt | 425/370 |
| 3,509,797 | A | 5/1970 | Johnson | |
| 6,632,165 | B1 * | 10/2003 | Letourneau et al. | 493/464 |
| 6,910,997 | B1 * | 6/2005 | Yampolsky et al. | 493/464 |
| 7,125,375 | B2 * | 10/2006 | Kung et al. | 493/464 |
| 7,260,922 | B2 | 8/2007 | Harding et al. | |
| 2004/0052988 | A1 | 3/2004 | Slovencik et al. | |
| 2008/0098699 | A1 | 5/2008 | Cheich et al. | |
| 2009/0082187 | A1 | 3/2009 | Cheich et al. | |

FOREIGN PATENT DOCUMENTS

| | | |
|---|---|---|
| JP | 08-001837 | 1/1996 |
| KR | 2002-0073610 | 9/2002 |
| WO | WO 95/29055 | 11/1995 |

OTHER PUBLICATIONS

International Search Report and Written Opinion dated Jun. 9, 2009 for International Application No. PCT/US2009/030576.

* cited by examiner

*Primary Examiner* — Hemant M Desai
(74) *Attorney, Agent, or Firm* — Dorsey & Whitney LLP

(57) ABSTRACT

The present subject matter relates generally to an apparatus for crumpling paper substrates. Specifically, the system provides for the crumpling of paper substrates to form fill material to be utilized in product packaging to fill void space and/or to wrap around products thereby allowing for safe transport of the products. The apparatus includes a feeder for feeding sheeting material, a first roller connected to a drive mechanism, a second roller disposed adjacent said first roller wherein said sheeting material travels between the first roller and the second roller and further wherein the second roller pushes said sheeting material against said first roller to engage the sheeting material with the first roller, and a third roller connected to the drive mechanism for directing said sheeting material out of said apparatus.

12 Claims, 15 Drawing Sheets

APPARATUS FOR CRUMPLING PAPER SUBSTRATES

The present invention is a continuation of U.S. patent application Ser. No. 12/008,166 filed Jan. 9, 2008 now U.S. Pat. No. 7,771,338, which is a Continuation-In-Part application of U.S. patent application Ser. No. 11/811,862 filed on Jun. 12, 2007 now U.S. Pat. No. 7,744,519 issued on Jun. 29, 2010, which claimed priority to U.S. Provisional Patent Application No. 60/844,565, filed on Sep. 14, 2006, U.S. Provisional Patent Application No. 60/853,585, filed on Oct. 23, 2006, and U.S. Provisional Patent Application No. 60/906,761 filed on Mar. 12, 2007, each of which is expressly incorporated herein in its entirety.

TECHNICAL FIELD

The present invention relates generally to a system and a method for crumpling paper substrates. Specifically, the system and method provide for the crumpling of paper substrates to form fill or cushioning material to be utilized in product packaging to fill void space and/or to wrap around products thereby allowing for safe transport of the products.

BACKGROUND

It is generally known to transport and/or store products. Products to be transported and/or stored typically are packed within a box or other container. However, in most instances, the shape of the product does not match the shape of the container. Most containers utilized for transporting products have the general shape of a square or rectangular box and, of course, products can be any shape or size. To fit a product within a container and to safely transport and/or store the product without damage to the product, the void space within the container is typically filled with a packing or cushioning material.

The packing material utilized to fill void space within a container is typically a lightweight, air-filled material that may act as a pillow or cushion to protect the product within the container. In many circumstances, a plastic bubble material is utilized to protect and cushion the product contained within a container. However, plastic bubble material, and the process for making the plastic bubble material, can be expensive and time-consuming to produce. In addition, plastic bubble material is not adequate form-filling material in many instances, requiring specially made shapes and/or bubble patterns to effectively protect and cushion a product within a container during transport and/or storage. Plastic bubble material is also not "environmentally friendly" in that these materials are not readily biodegradable when exposed to the environment.

Small Styrofoam nuggets or "peanuts" may also be utilized to fill void space within containers for protecting and cushioning a product within a container during transport and/or storage. These nuggets or "peanuts" are also expensive to produce, and may not adequately protect a product unless a great number are used within the container to entirely fill the void space within the container. In addition, it is also difficult to contain the Styrofoam nuggets or "peanuts" within the container, especially after the container has been opened. These materials are typically extremely lightweight, and can easily blow away if caught within a wind or draft. These materials may also cause environmental degradation, as they are not readily biodegradable.

Another typical material utilized for filling void space within containers, and for protecting and cushioning a product contained within the container, is paper and/or paper substrates. Typically, sheets of paper material may be crumpled so as to form long shapes having many folds or pleats. Lengths of crumpled paper may be created to easily and effectively fill void space within a container holding a product. Because the paper has fold spaces and/or pleats, the crumpled paper may be very effective at protecting and cushioning a product contained within the container, and may effectively prevent damage to the product during transport and/or storage.

Sheets of paper may be crumpled by hand, in that a person may take a length of a sheet of paper, and crumple the paper to form various shapes to fill void space within a container to protect and cushion a product contained therein. However, hand crumpling paper takes much time, and is not effective and/or efficient to provide a large amount of crumpled paper as may be needed in a production line. Machines, therefore, are necessary to crumple paper.

Typical machines utilized to crumple paper generally take a length of a sheet of paper, and feed the paper into a crumpling zone of the machine to provide a crumpled paper product. However, typical machines suffer from a host of problems. For example, long sheets of paper substrate material are typically provided on rolls and are fed into machines at a high rate of speed. It is difficult to control the rate of speed for the paper substrate to be removed from the roll. Without a braking mechanism, the roll unwinds at a higher rate of speed than the paper is being fed into the machine causing paper to spill off the roll. Typically, this occurs when the rate of paper being fed into the crumpling machine slows, and momentum causes the roll, which is heavy with paper, to continue rolling. A need exists, therefore, for a crumpling machine having an adequate braking mechanism to solve this problem.

In addition, typical braking mechanisms utilized for rolls of paper sheeting involve a system utilizing an axis bar that is disposed entirely through the core of a paper roll. A tensioned washer or disk is typically provided on either or both sides of the paper roll that may apply pressure to one or both of the side surfaces of the paper rolls to prevent the roll from spinning when the machine is not ready to receive paper, thereby preventing spillage of the paper off the roll. This braking mechanism, however, is typically extremely heavy and bulky, in that it requires a heavy metal axis bar that must then be dropped within arms to hold the paper roll in place. It is difficult to quickly and efficiently remove and add paper rolls to paper crumpling machines utilizing a braking mechanism as described above. A need exists, therefore, for a braking mechanism and paper roll-holding mechanism allowing for easy and efficient removal and replacement of paper rolls.

Moreover, typical machines utilized for crumpling paper do not adequately distribute load laterally across the paper from end to end. Frequently, long sheets of paper substrate may tear when being fed within the paper crumpling machine. Typically, this occurs due to tension applied to the edges of the paper sheet, which is typically the weakest part of the paper sheet. Small fissures or tears in the edges of the paper sheeting can become large tears, or tears that completely traverse the paper sheeting, when tension is applied to the edges of the paper sheeting. A need exists, therefore, for a paper sheeting guide that allows paper sheeting to be fed into a paper crumpling machine without causing unnecessary tears or rips in the paper sheeting.

In addition, tension may be unevenly distributed longitudinally causing problems during the crumpling process of the paper sheeting, especially through the feed mechanism. Uneven shapes or thicknesses of the crumpled paper, in addition to differences in paper feed rates, may cause slippage of the paper sheeting through the crumpling machines. A need exists, therefore, for a crumpling process and/or feed mechanism that automatically adjusts tension based on the shape, thickness and/or speed of the crumpled paper fed therethrough.

Typical crumpling machines utilize, generally, hard materials for feeding and/or crumpling paper fed therethrough. Specifically, metal cylinders, with or without teeth, may be utilized for feeding paper through the machine. The hardness of the feeding and/or crumpling mechanism may be directly responsible for lateral tears or rips of the paper sheeting, and may typically produce an abundance of noise during the paper crumpling process. In addition, metal, or other hard feeding and/or crumpling mechanisms, may not provide adequate traction for the paper sheeting fed therethrough. A need, therefore, exists for a feeding and/or crumpling mechanism made from relatively soft materials that may solve the problems associated with utilizing metal in the feeding and/or crumpling mechanisms.

Moreover, a paper crumpling machine should allow for the tearing of the crumpled paper when desired. Typically, a knife may be utilized to cut the crumpled paper such that individual lengths of crumpled paper may be produced. Typical knives utilized for cutting lengths of crumpled paper can be dangerous, especially since the blade can be exposed in an area of the crumpling machine that typically requires an individual to place his or her hands therein to pull paper therethrough for setting up or clearing a jam from the machine. A need exists, therefore, for a cutting mechanism that is safe and does not injure an individual that must place his or her hands in the machine to feed the paper therethrough.

In addition, a paper crumpling machine should also allow for efficient loading of the successfully crumpled paper into a container for storage or transport. The crumpled and cut paper should exit the crumpling machine with minimal or no buildup that could jam the machine. Typical paper crumpling machines that steer or manipulate the paper into a container as the paper is moving can cause the paper to backup and jam the apparatus, for example, by causing buildup of material near the drive rollers. A need exists, therefore, for a machine comprising an exit zone that efficiently moves crumpled and cut material away from the crumpling zone and cutting mechanism, and into a suitable container.

SUMMARY

The present subject matter relates generally to a system and a method for crumpling paper substrates. Specifically, the system and method provide for the crumpling of paper substrates to form dunnage or fill material to be utilized in product packaging to fill void space and/or to wrap around products thereby allowing for safe transport of the products.

To this end, in an embodiment of the present invention, a paper crumpling apparatus is provided. The paper crumpling apparatus comprises a paper feeder for feeding paper sheeting, wherein said paper feeder comprises a guide having a plurality of tines for guiding the paper sheeting; and a paper crumpling zone wherein said paper crumpling zone crumples the paper sheeting fed thereinto by the paper feeder.

In an alternate embodiment of the present invention, a paper crumpling apparatus is provided comprising a paper feeder for feeding paper sheeting; and a crumpling zone wherein said crumpling zone crumples the paper sheeting fed thereinto by the paper feeder, wherein said paper feeder comprises a brake arm having a tapered cap for disposing in an opening of a paper roll such that the cap brakes the spin of the paper roll.

In a further alternate embodiment of the present invention, a paper crumpling apparatus is provided comprising a paper feeder for feeding paper sheeting; a crumpling zone wherein the crumpling zone crumples the paper sheeting fed thereinto by the paper feeder; and a tensioner for supplying tension to the paper sheeting, wherein said tensioner increases tension on the paper sheeting when a rate of feeding the paper sheeting into the crumpling zone increases.

In addition, in a further alternate embodiment, a paper crumpling apparatus is provided comprising a paper feeder for feeding paper sheeting; a crumpling zone wherein the crumpling zone crumples the paper sheeting fed thereinto by the paper feeder; a paper cutter; and a drive for alternately feeding the paper sheeting into the crumpling zone and cutting the paper with the paper cutter.

Moreover, in a still further alternate embodiment of the present invention, a paper crumpling apparatus is provided comprising a paper feeder for feeding paper sheeting; a crumpling zone wherein the crumpling zone crumples the paper sheeting fed thereinto by the paper feeder; a paper cutter for cutting the paper sheeting after being crumpled in the crumpling zone, wherein said paper cutter comprises a blade, wherein said paper cutter comprises a protective bottom plate section and further wherein said blade extends from said protective bottom plate section when said paper cutter cuts the paper sheeting.

In a further alternate embodiment of the present invention, a paper crumpling apparatus cutting mechanism is provided comprising a pusher, wherein said pusher comprises at least one arm attached to at least one rod driven by a motor, a blade, and a protective bottom plate section, wherein said bottom plate section prevents the blade from being exposed unless the rods are engaged by a motor causing the pusher to compress the bottom plate section thereby exposing the blade and cutting the paper.

In a still further alternate embodiment of the present invention, a paper crumpling apparatus tearing mechanism is provided comprising a pusher, wherein said pusher comprises at least one arm attached to at least one rod driven by a motor, a bottom plate section, and perforated paper, wherein said rod, when engaged by the motor, pulls the pusher down onto the bottom plate section thereby clamping the perforated paper between the pusher and the bottom plate section.

Moreover, in a still further alternate embodiment of the present invention, a paper crumpling apparatus is provided comprising a brake arm having a tapered cap for disposing in an opening of a paper roll such that the cap brakes the spin of the paper roll as paper sheeting is removed from said paper roll; a paper feeder for feeding paper sheeting, wherein said paper feeder comprises a guide having a plurality of tines for guiding the paper sheeting; a crumpling zone wherein the crumpling zone crumples the paper sheeting fed thereinto by the paper feeder; a tensioner for supplying tension to the paper sheeting, wherein said tensioner increases tension on the paper sheeting when a rate of feeding the paper sheeting into the crumpling zone increases; a paper cutter; and a drive for alternately feeding the paper sheeting into the crumpling zone and cutting the paper sheeting with the paper cutter.

In a further alternate embodiment of the present invention, a paper crumbling apparatus is provided comprising a paper feeder for feeding paper sheeting; and a crumpling zone wherein said crumpling zone comprises a door that is removably attached to one or more guide rollers, wherein one or more guide rollers may disengage from the paper sheeting upon overload of paper sheeting in the crumpling zone and/or upon opening of a machine door by an operator.

In a further alternate embodiment, a paper crumbling apparatus is provided comprising a cutting mechanism wherein said cutting mechanism comprises a blade that is semi-rigidly attached to one or more mounting blocks, wherein the angle of contact of said blade to said paper may be change within the range of motion permitted to the blade within a mounting slot.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENT PREFERRED EMBODIMENTS

Figure 1:
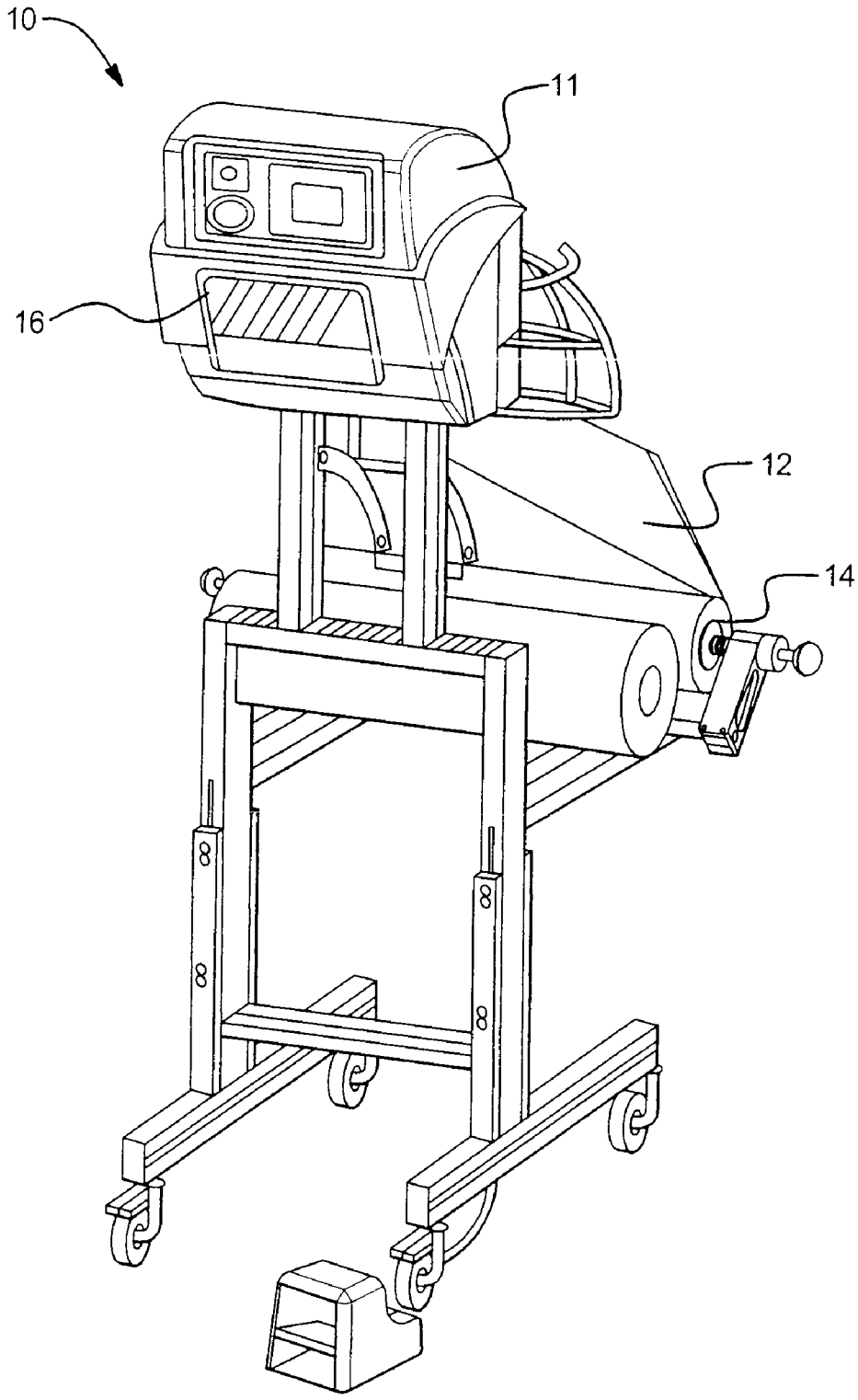
FIG. 1 illustrates a perspective view of a paper substrate crumpling apparatus in a particularly preferred embodiment of the present invention.

The invention and embodiments described herein relates generally to a system and a method for crumpling paper substrates. Specifically, the system and method provide for the crumpling of paper substrates to form fill material to be utilized in product packaging to fill void space and/or to wrap around products thereby allowing for safe transport of the products.

Illustrative embodiments will now be described to provide an overall understanding of a paper crumpling system and a method for crumpling paper. One or more examples of the illustrative embodiments are shown in the drawings. Those of ordinary skill in the art will understand that each disclosed embodiment or portion of the paper crumpling system and method of crumpling paper can be adapted and modified to provide alternative embodiments, and that other additions and modifications can be made to the disclosed paper crumpling system and method of crumpling paper without departing from the scope of the present disclosure. For example, features of the illustrative embodiments can be combined, separated, interchanged, and/or rearranged to generate other embodiments. Such modifications and variations are intended to be included within the scope of the present disclosure.

Unless otherwise provided, when the articles "a" or "an" are used herein to modify a noun, such articles can be understood to include one or more than one of the modified noun.

Referring now to the figures, wherein like numerals refer to like parts, FIG. 1 illustrates a paper crumpling apparatus 10. The paper crumpling machine 10 generally takes in paper sheeting 12, typically provided on a roll 14, and feeds said paper sheeting 12 into the paper crumpling machine 10 through a paper crumpling zone 11. The paper crumpling apparatus 10 crumples the paper sheeting 12 in a generally longitudinal pattern, thereby putting a series of longitudinal folds and/or pleats within the paper sheeting 12. The paper sheeting 12 exits the paper crumpling apparatus 10 via an exit 16. The crumpled paper can be added directly to a box or other container for filling void space within the box thereby protecting a product contained therein from damage during transport and/or storage of the product. Alternatively, the crumpled paper may be collected and stored and added to a box or container at a later time.

The paper sheeting 12 may be any size or kind apparent to one having ordinary skill in the art that is sufficiently wide to enter the paper crumpling apparatus 10 and have folds and/or pleats applied thereto. Typically, the paper sheeting 12 is anywhere between about 15 inches and about 36 inches, although any other width may be utilized. Moreover, the paper sheeting may be made from virgin paper fibers and/or recycled paper fibers, such that the paper sheeting has sufficient strength to be taken from the roll 14 and fed through the paper crumpling machine without unreasonable tearing or ripping thereof. The paper sheeting 12 may further have perforations pre-pressed into the paper at set intervals to allow for intentional tearing of the paper.

Figure 2:
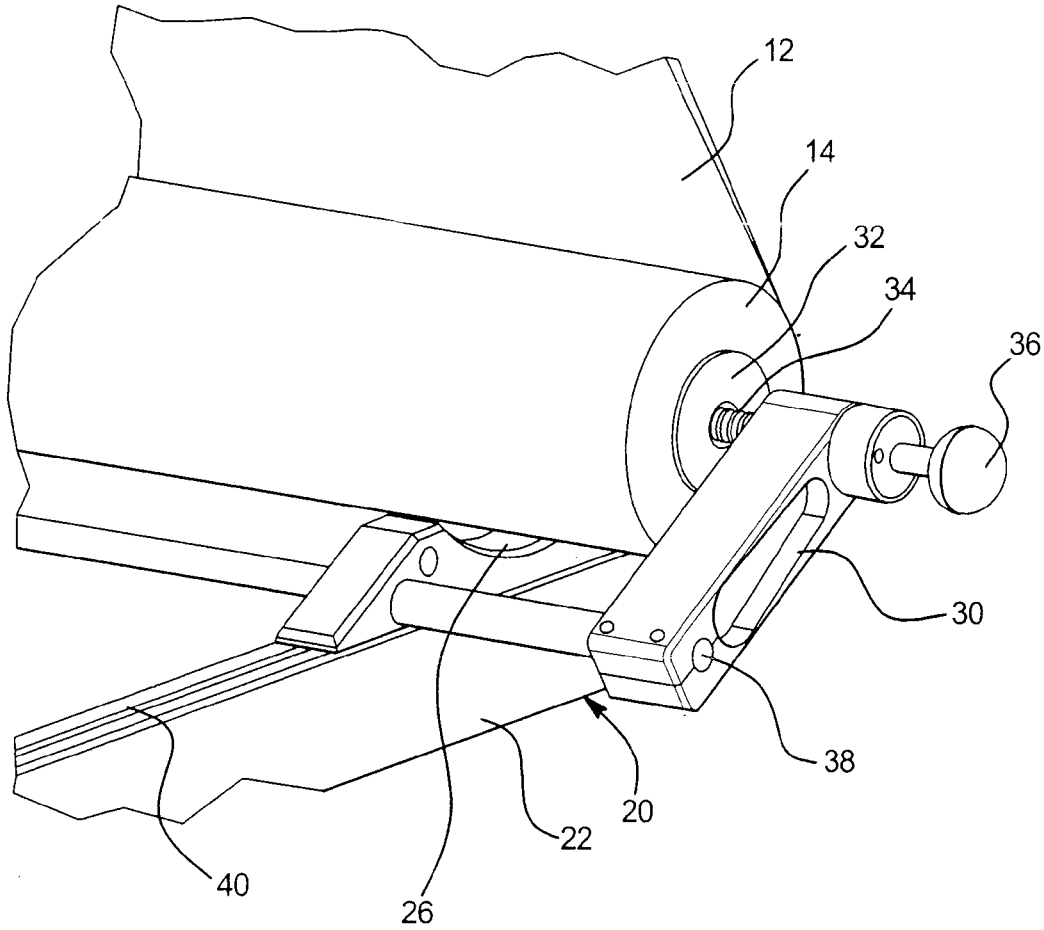
FIG. 2 illustrates a side perspective view of a paper roll and braking mechanism in an embodiment of the present invention.

In a preferred embodiment of the present invention, illustrated in FIG. 2, the roll 14 of the paper sheeting 12 sits on a platform 20. The roll 14 sits on at least one arm 22 having an upper surface 26. The upper surface 26 may provide a contact surface for the roll 14. Specifically, the upper surface 26 may be curved, as illustrated in FIG. 2, to generally contour to the shape of the roll 14 to optimize the amount of surface area of the upper surface 26 contacting the roll 14. However, the present invention should not be limited in this way, and the upper surface 26 may be any shape and may provide any amount of surface area for contacting the roll 14. Moreover, any number of arms may be utilized to hold the roll 14, including a single arm, or a plurality of arms, each having an upper surface for the roll 14 to be disposed thereon.

The upper surface 26 provides a first portion of a brake mechanism that prevents the paper sheeting 12 on the roll 14 from uncontrolled unrolling or unraveling, such as would happen when the roll 14 rolls at a faster rate than the paper crumpling apparatus 10 feeds the paper sheeting 12 therethrough. For example, if the paper crumpling apparatus 10 takes up paper sheeting 12 at a first rate, then slows down suddenly to a second rate, the momentum of the roll 14 may cause the rate of the spin of the roll 14 to remain fast, if there is no braking mechanism to keep the roll 14 from rolling at the faster rate. The friction of the roll 14 on the upper surface 26 of the arm 22 provides the braking mechanism, in that the weight of the roil 14 on the upper surface 26 provides sufficient friction to prevent the paper sheeting 12 from uncontrolled unrolling. The friction of the upper surface 26 and the roll 14 may be influenced by a host of factors, including the material utilized for the upper surface 26, the shape of the upper surface 26, and/or the type of paper being fed.

The roll 14 may further be removably engaged or otherwise connected to an brake arm 30 that is engaged to an open end of the core of the roll 14 of the paper sheeting 12 via a cap 32. The cap 32 fits within the open end of the core of the roll 14 and contacts the inside surface of the core of the roll 14. The core of the roll 14 is typically a tube of rigid material, such as cardboard, that holds the paper sheeting wrapped therearound.

To provide braking capabilities for the roll 14, the cap 32 does not spin with the roll 14, but provides friction to the inside surface of the core of the roll 14 to keep the roll 14 from uncontrolled unraveling. The cap 32 is tapered so as to engage the inside surface of the core of the roll 14, and may continue to provide a friction surface if the inside surface of the open end of the roll wears down through use. A spring 34 engages the cap and allows a plunger 36 to push the cap against the opening of the roll 14 to provide the requisite friction to prevent uncontrolled unrolling or unraveling of the roll 14. The spring further helps the cap 32 maintain engaged contact with the inside surface of the core of the roll 14 when the inside surface of the core of the roll 14 wears due to use.

To disengage the roll 14 from the paper crumpling apparatus 10, the plunger 36 may be pulled, thereby disengaging the cap 32 from the opening in the roll 14, and the roll 14 may be removed. Alternatively, to engage the roll 14 of the paper sheeting 12, the plunger 36 may be pulled, thereby allowing an individual to place the roll on the upper surface 26 of the arm 22, and the cap 32 may be fit within the opening on the side of the roll 14 formed by the core of the roll 14.

The brake arm 30 has a pivot point 38 allowing the arm to pivot. When the cap 32 is engaged to the opening of the roll 14 of the paper sheeting 12, the brake arm 30 has the dual function of maintaining the roll 14 in position on the upper surface 26 of the arm 22, but to also allow the weight of the roll 14 of the paper sheeting 12 to allow the roll 14 to maintain contact with the upper surfaces 26 of the arm 22. As the roll 14 of the paper sheeting 12 unwinds, the radius of the roll 14 decreases, and the roll 14 must fall to maintain contact with the upper surface 26 of the arm 22. The pivot point 38 allows the brake arm 30 and, consequently, the roll 14 to fall and maintain contact with the upper surface 26 of the arm 26.

The braking mechanism utilized to prevent the roll 14 of the paper sheeting 12 from unrolling or unraveling uncontrollably is provided by both the contact of the roll 14 with the upper surfaces 26 of the arms 22, and the contact of the opening of the roll 14 of the paper sheeting 12 with the cap 32. The brake arm 30 also maintains the roll 14 in position on the arm 22. In addition, a second brake arm (not shown) may be provided on the opposite side of the roll 14 to provide the same function as the brake arm 30, including a cap (not shown) engaged with an opening of the roll 14 of the opposite side of the roll 14. The second brake arm may, generally, be identical to the brake arm 30, thereby allowing engagement of the cap (not shown) with the second opening (not shown) of the roll 14. The second brake arm on the opposite side may further have a pivot point (not shown) for allowing the second brake arm to pivot when the roll 14 unrolls during use of the paper crumpling apparatus 10.

A storage space 40 may be provided on the arm 22 for storing a second roll 42 (not shown). When the roll 14 must be replaced, such as when all or most of the paper sheeting 12 is removed from the roll 14 and fed into the paper crumpling machine 10, the roll 42 may be moved into position on the upper surface 26 of the arm 22 and the openings in the core of the roll 42 may engage the cap 32 and the cap on the opposite side (not shown). A third roll of paper sheeting may then be placed on the storage space 40 until the roll 42 is depleted.

Figure 3A:
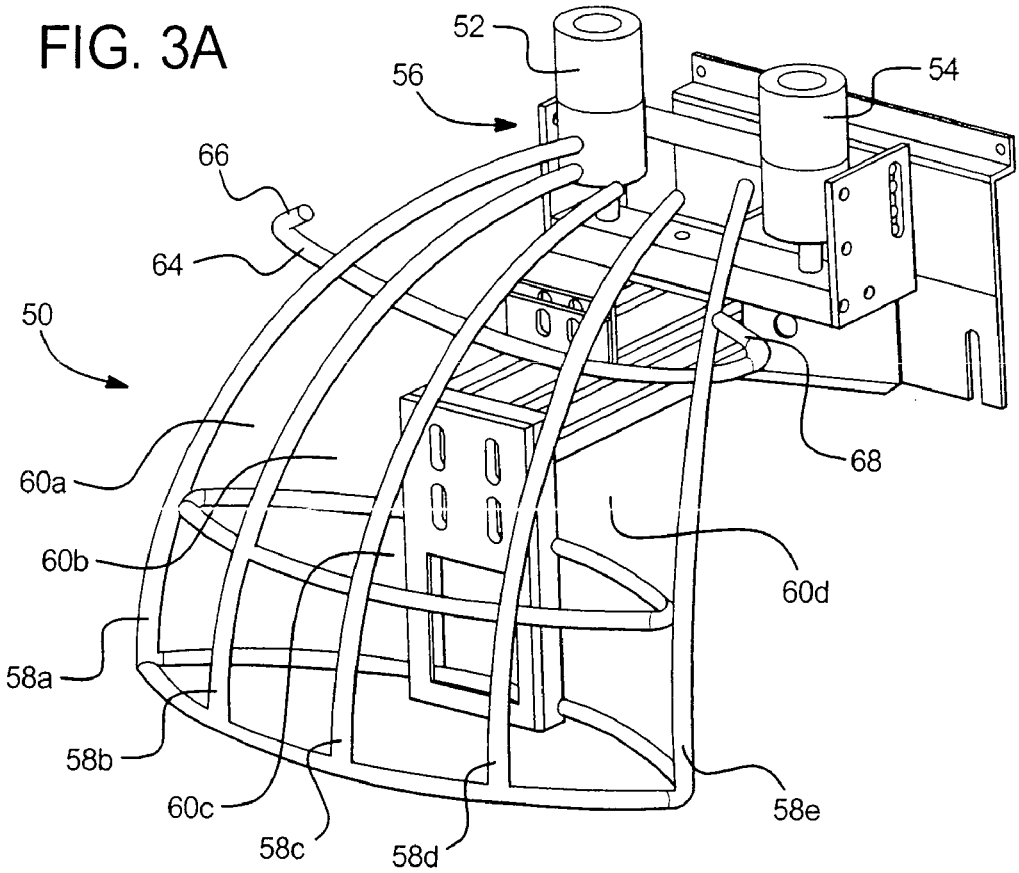
FIGS. 3A-3B illustrate views of a paper sheeting feed guide and feed rollers, as a portion of the crumpling machine in an embodiment of the present invention.

FIG. 3A illustrates a rake 50 that acts as a guide for paper sheeting 12 from the roll 14 that may be disposed below the rake 50. The paper sheeting 12 ascends from the roll 14 and the underside thereof contacts the rake 50, and the rake 50 guides the paper sheeting 12 toward the rollers 52, 54 disposed near a top 56 of the rake 50, where the total width of said paper sheeting is reduced by forming waves therein, as described below, and the paper sheeting 12 is passed through said rollers 52, 54.

Figure 3B:
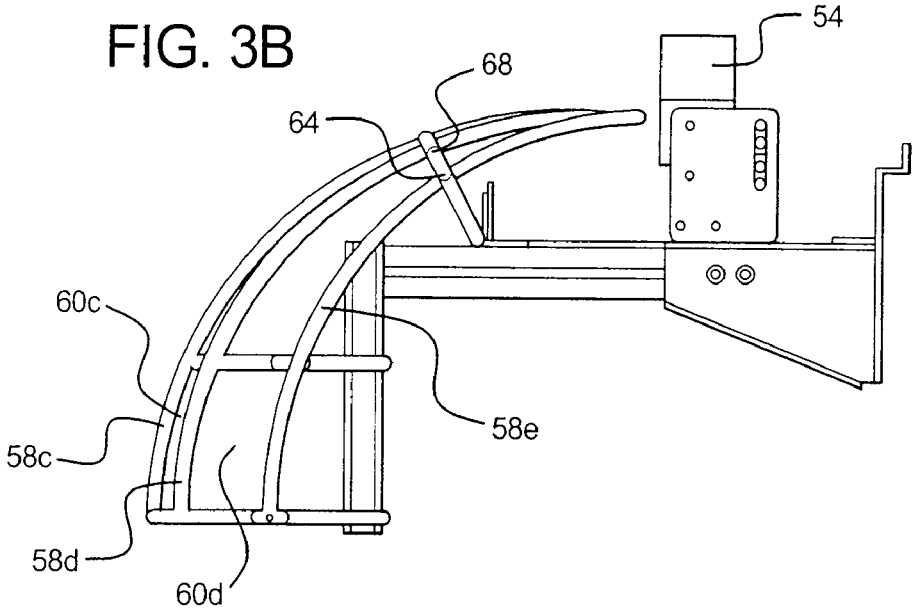

The rake 50 may have a plurality of tines 58*a*, 58*b*, 58*c*, 58*d* and 58*e* for guiding the paper sheeting 12 toward the rollers 52, 54. Between the plurality of tines 58*a*-58*e* may be a plurality of spaces 60*a*, 60*b*, 60*c* and 60*d*. The plurality of space 60*a*-60*d* provide space for the paper sheeting 12 to be pushed or fall into, thereby creating troughs in the paper sheeting 12 as the paper sheeting 12 is fed toward the rollers 52, 54. FIG. 3B illustrates a frontal view of the rake 50 having paper sheeting 12 fed thereover. As shown in FIG. 3B, the paper sheeting 12 falls into spaces 60*a*-60*d*, thereby introducing troughs in the paper sheeting 12. The troughs allow the paper sheeting 12 to reduce in width for entering through the rollers 52, 54. Ultimately, the troughs further cause longitudinal folds and/or pleats to be formed in the paper sheeting 12 prior to exiting the paper crumpling machine 10.

The tines 58*a*-58*e* are shaped in such as way as to efficiently guide the paper sheeting 12 through the rollers 52, 54. Moreover, the tines 58*a*-58*e* are further shaped to allow the paper sheeting 12 to form the troughs therein. A preferred embodiment of the present invention is illustrated in FIGS. 3A-3B, whereby the tines 58*a*-58*e* are curved longitudinally (i.e., in the direction of paper travel in FIGS. 3A-3B), and a surface disposed laterally across the tines 58*a*-58*e* is also curved. In addition, any number of tines may be utilized as apparent to one having ordinary skill in the art. It has been found that the number of tines, the size of the tines, and the space between the tines is influenced by the width of the paper sheeting 12. Paper sheeting having a larger width may require more and longer tines spaced further apart than paper sheeting having a smaller width. A general rule is that the width of the rake at a lower end 57 should be approximately ⅔ the width of the paper sheeting 12.

A horn 64 may also help guide the paper sheeting 12 through the rollers 52, 54. Horn arms 66, 68 help prevent the paper sheeting from moving laterally with respect to the direction of feeding the paper sheeting through the rollers 52, 54. In addition, the horn arms 66, 68 help the edges of the paper sheeting 12 to fold under the paper sheeting, thereby removing tension or load from the edges of the paper sheeting 12. Tears or rips in the paper sheeting 12 frequently are due to tension placed on the edges of the paper sheeting, where small fissures in the paper sheeting 12 may develop into larger and more destructive tears or rips in the paper sheeting 12. By folding the edges of the paper sheeting 12 thereunder, the outer edge of the paper sheeting 12 becomes the first fold line disposed on opposite sides of the paper sheeting. FIG. 3B illustrates first fold lines 70, 72 that are disposed in the paper sheeting 12 with the aid of the horn 64 and horn arms 66, 68.

The rollers 52, 54 may allow the paper sheeting 12 to traverse therethrough, and provide guidance for the paper sheeting as it moves to the next stage of the paper crumpling process. Moreover, the rollers 52, 54 may cause a further reduction in the width of the paper sheeting 12 after passing over the rake 50. The rollers may be made from any material, such as thermoplastic polymeric material, metal, or any other material apparent to one having ordinary skill in the art. In a preferred embodiment, the rollers 52, 54 may be made from soft thermoplastic material, such as polyurethane, for example. The soft thermoplastic material provides increased friction when the rollers 52, 54 contact the paper sheeting 12, thereby reducing slippage of the paper sheeting 12 as it passes therethrough. Softer thermoplastic materials also tend to decrease the potential for damaging the paper sheeting 12 as it passes therethrough.

In this embodiment, rollers 52 and 54 together form a neck at about the end of rake 50. The width of the paper sheeting material may be reduced as it travels through the neck area. As noted above, the neck is preferably but not necessarily formed from one or more rollers. Although FIG. 3A illustrates two rollers (52,54), any number of rollers may be utilized to fulfill the function of guiding the paper sheeting 12 to the next stage. Moreover, the rollers 52, 54 may be replaced by stationary pins, or other means, having a relatively hard and/or smooth surface, that act as guides for the paper sheeting 12, and should not be limited as herein described.

FIG. 3B illustrates a side view of the rake 50 illustrating a preferred embodiment showing the curvature of the tines both longitudinally and laterally, which maximizes the efficiency of the paper sheeting 12 fed thereover.

The next stage of the paper crumpling process involves feeding the paper substrate into a paper crumpling zone 100, as shown in the cut-away perspective view of the paper crumpling zone 100 in FIG. 4. In general, the paper sheeting 12, after traveling over the rake 50, is reduced in width by the addition of waves or troughs in the paper sheeting caused by the tines 58*a*-58*e* and the spaces 60*a*-60*d* between the tines 58*a*-58*e*, and is permanently deformed, or crumpled, after passage through the paper crumpling zone 100. The paper sheeting 12 is pressed and the waves disposed therein form folds and/or pleats within the paper sheeting 12. These folds and/or pleats form a crumpled paper product that is usable as a dunnage or void fill for packaging.

The paper sheeting 12, after traveling over the rake 50, is guided under first guide roller 102 and disposed adjacent to drum 104. The paper sheeting 12 traverses over the surface of the drum 104 and between the drum 104 and a second guide roller 106. After passing through a space between the second guide roller 106 and the drum 104, the crumpled paper product traverses through opening 108. The folds and/or pleats formed within the paper sheeting 12 are formed primarily when the paper sheeting passes between the drum 104 and the second guide roller 106.

Figure 4A:
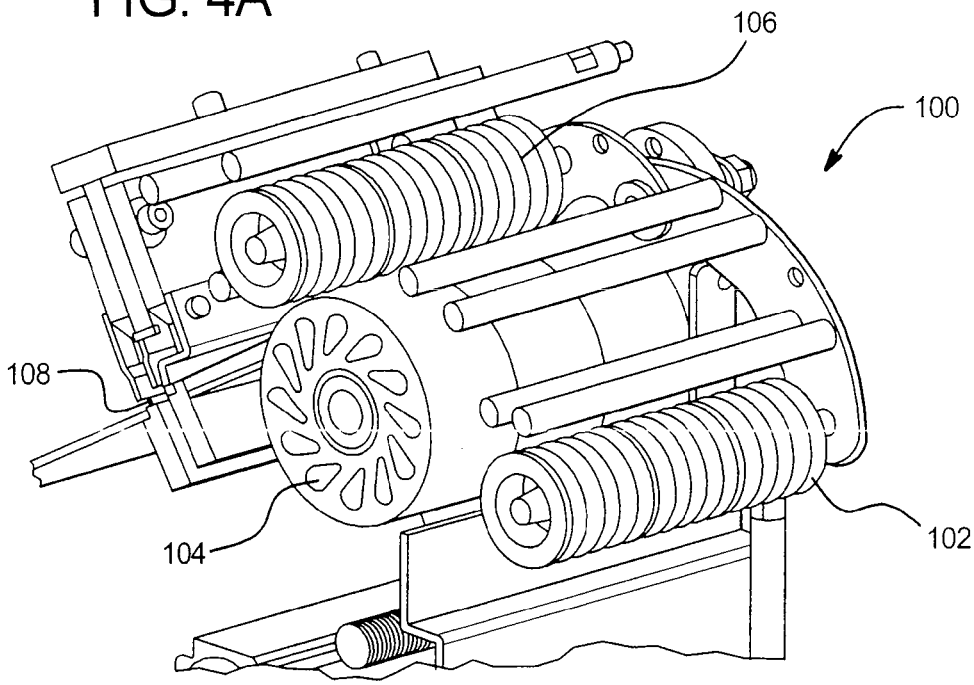
FIGS. 4A-4B illustrate a top cut-away perspective view and a side cut-away view of a feed/crumple mechanism in an embodiment of the present invention.
Figure 4B:
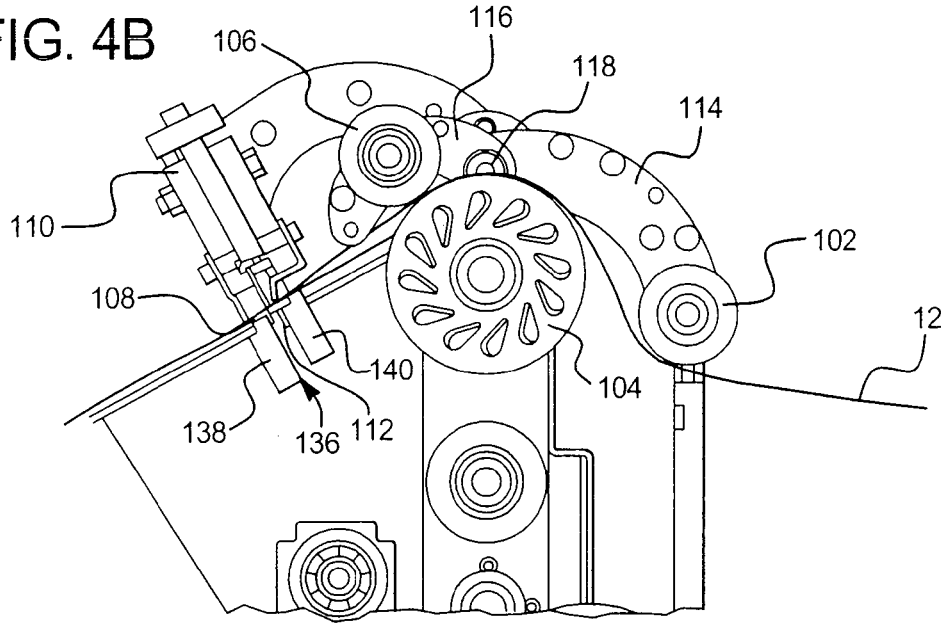

The drum is interconnected with a drive mechanism that allows the drum to rotate in a direction so as to feed the paper sheeting 12 through the paper crumpling zone 100. In FIG. 4A, the drum 104 rotates counterclockwise. FIG. 4B illustrates a cut-away side view of the paper crumpling zone 100 illustrating how the paper sheeting 12 is fed therethrough, and the direction of travel of the paper sheeting 12. As seen, the second guide roller 106 is disposed very close to the drum 104 so that the paper sheeting 12 and waves disposed therein are crushed to form folds and/or pleats.

Figure 6:
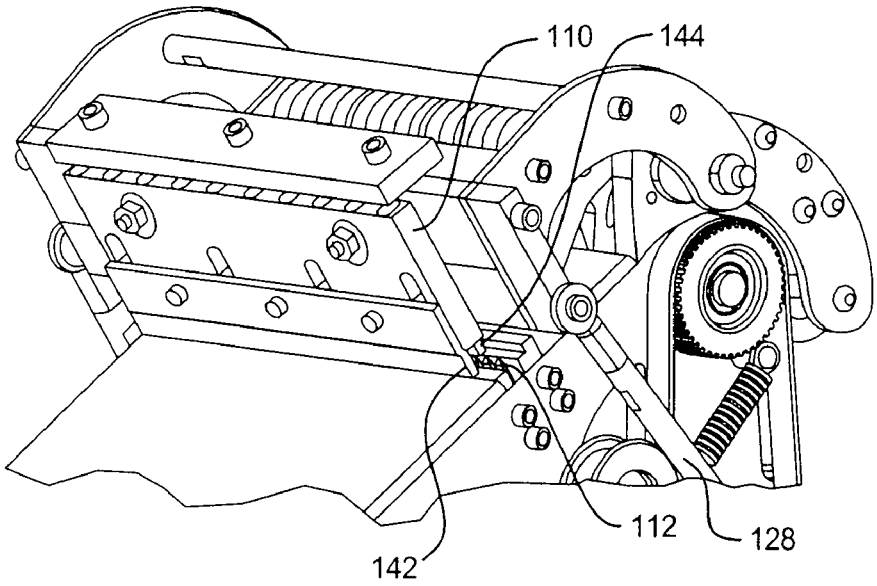
FIG. 6 illustrates a close-up view of the cutting mechanism in an embodiment of the present invention.
Figure 7:
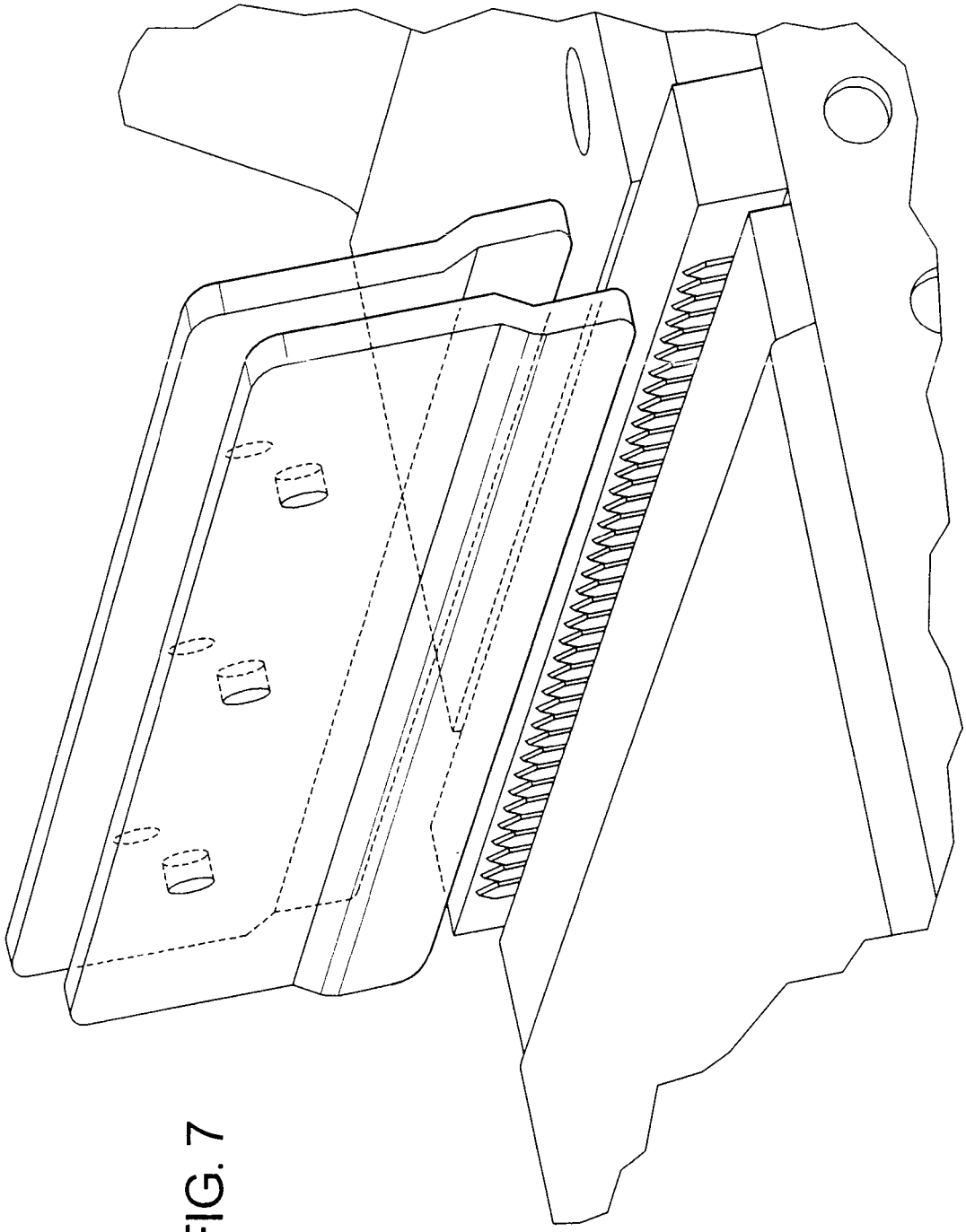
FIG. 7 illustrates a side perspective view of a cutting mechanism for the paper sheeting in an embodiment of the present invention.

Near the opening 108 is a pusher 110 and a bottom plate section 136 having a first portion 138 and a second portion 140 with a blade 112 disposed therein, as shown in FIG. 7. The blade allows the paper sheeting 12 to be cut at desired locations to form crumpled paper products of any desired length. The mechanism for allowing the blade to be exposed and cut through the paper sheeting 12 is described below with respect to FIGS. 5-9. The blade 112 generally has a plurality of teeth that may puncture and slice the paper sheeting 12 fed therethrough. Since the paper sheeting 12 is provided with a plurality of folds and pleats at this point, the paper sheeting must engage the blade 12 with sufficient force to cut the paper sheeting 12 completely through.

Still referring to FIGS. 4A-4B, the first and second guide rollers 102, 106 may be made from any material useful for guiding the paper sheeting 12 and pulling the paper sheeting 12 through the paper crumpling zone 100. Preferably, the first and second guide rollers 102, 106 are made from a soft thermoplastic material, such as polyurethane, or other similar soft material, thereby providing a gripping mechanism on the paper sheeting without tearing the paper sheeting 12. Specifically, first and second guide rollers made from soft material, such as polyurethane or other material, provides traction for feeding the paper sheeting 12 therethrough and roll very smoothly and without excessive noise.

The first and second guide rollers 102, 106 are self-tensioning, and respond when the paper sheeting is fed therethrough at increased or decreased speeds. For example, if the drum 104 turns faster, the interaction of the drum 104 and the second guide roller 106 pulls the paper sheeting 12 therethrough at a faster rate. When tension is increased on the paper sheeting 12, it causes the first guide roller to get pushed upwards by the paper sheeting material 12. In response, a first tensioning arm 114, interconnected with a second tensioning arm 116 through a pivot point 118, causes the second tensioning arm 116 to push downwardly, thereby pushing the second guide roller 106 closer to the drum 104. This has the effect of increasing the pressure applied to the paper sheeting 12 at the convergence point of the second guide roller 106 and the drum 104, increasing quality of the folds and/or pleats disposed therein, and providing increased traction of the second guide roller 106 on the paper sheeting 12. When speed decreases, the first guide roller 102 is allowed to fall downwardly thereby reducing tension on the second guide roller 106 and allowing the second guide roller to lift away from the drum 104 via the pivot point 118.

Figure 5:
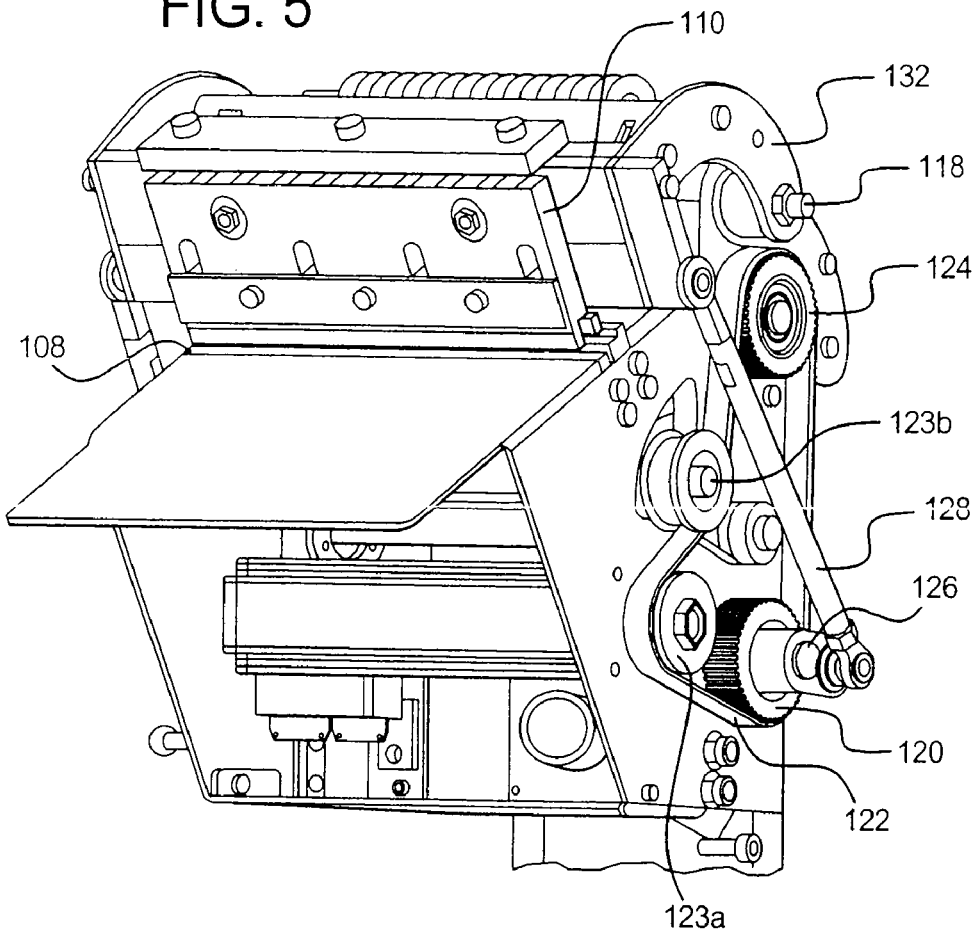
FIG. 5 illustrates a front perspective view of a cutting mechanism for the paper sheeting in an embodiment of the present invention.

FIG. 5 illustrates a side perspective view of the paper crumpling zone 100, showing a drive mechanism and a cutter mechanism. Specifically, a first cylinder 120 is connected to a motor (not shown) for spinning said first cylinder 120 in either of two directions. A belt 122 wraps around the cylinder 120 through a plurality of guide cylinders 123*a*, 123*b* and ultimately engages a second cylinder 124 that is directly attached to the drum 104, as shown in FIGS. 4A-4B. The second cylinder 124 may be connected to the drum 104 by a clutch bearing (not shown) such that the drum 104 may only spin in one direction (counterclockwise in the view shown in FIG. 5). When the first cylinder 120 spins counterclockwise, the belt engages the second cylinder 124 and spins the second cylinder 124 counterclockwise, thereby spinning the drum 104, which feeds the paper sheeting through the paper crumpling zone 100. However, when the motor reverses, the first cylinder 120 spins in a clockwise direction, and the second cylinder 124 also spins in a clockwise direction, but the clutch bearing does not allow the drum 104 to spin. Therefore, the drum 104 may only spin when the second cylinder 124 spins in one of the two directions via the motor (not shown). Alternatively, the first and second cylinders 120, 124, and hence, the paper feed mechanism and the cutter mechanism, may be driven by two independent motors (not shown).

A crank 126 may be attached to the first cylinder 120, and may further be attached thereto with a second clutch bearing (not shown), such that the crank 126 may only spin when the first cylinder turns in one of the two directions. In the present embodiment, the crank 126 only spins when the first cylinder 120 spins in a clockwise direction, in the view shown in FIG. 5. The crank 126 is attached to an arm 128 that is attached to the head 110. When the crank 126 spins, the arm 128 may move linearly, or mostly linearly, thereby pulling the head 110 in a downward direction. The head 110 may be attached to the pivot point 118, or other pivot point via the extension arm 132, allowing the head 110 to move upwardly or downwardly, as necessary.

The first cylinder 120, the second cylinder 124, the crank 126, the arm 128 and the clutch bearings (not shown) allow either a single motor or two separate motors to drive both the paper feed mechanism and the cutting mechanism of the paper crumpling apparatus 10 of the present invention. If a single motor is utilize, the paper feed mechanism and cutter mechanism may operate by merely reversing the rotation of the drive.

Figure 8:
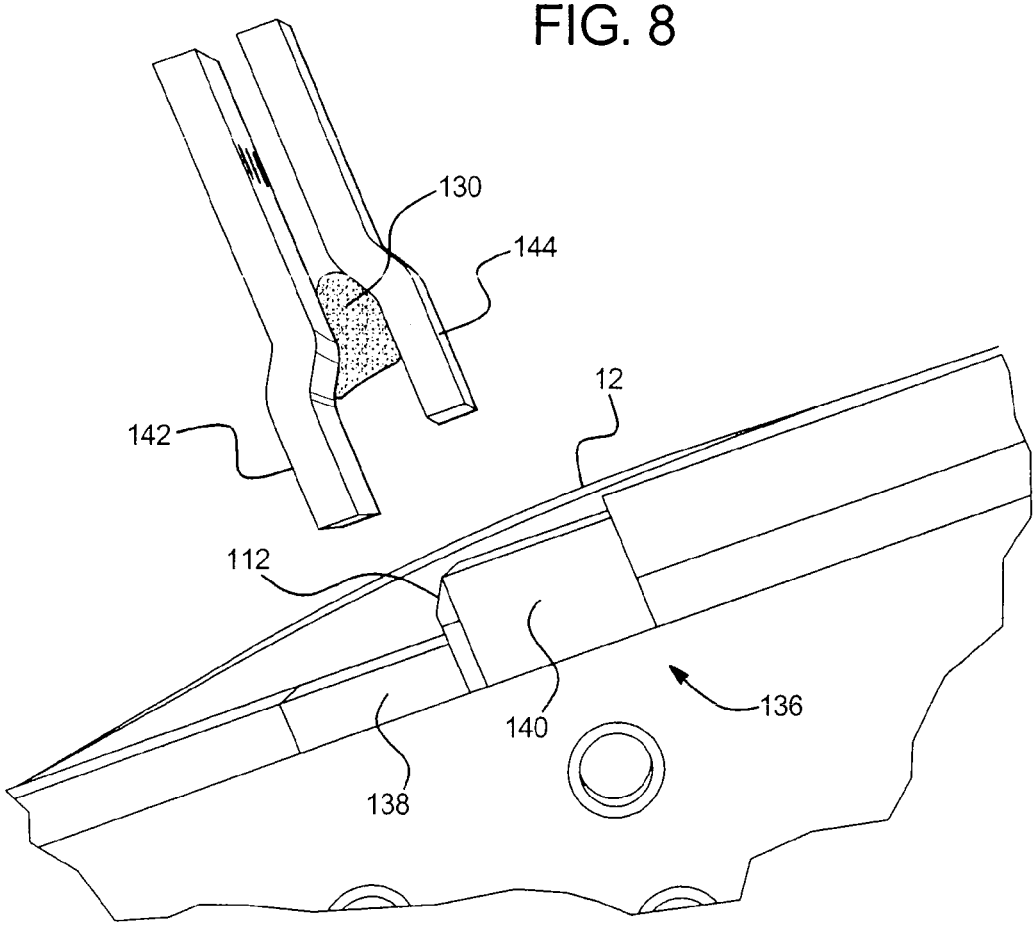
FIG. 8 illustrates a side view of a cutting mechanism for the paper sheeting in an embodiment of the present invention.

Attached to the head 110 is a first pusher 142 and a second pusher 144 which may further traverse in the downward direction when the head 110 moves in the downward direction, caused by the pulling of the arm 128 via the crank 126, as shown in FIGS. 6-7. The first pusher 142 and the second pusher 144, when pulled down against the first portion 138 and the second portion 140 of the bottom plate 136 expose the blade 112, and the blade 112 may cut the paper sheeting 12 that may be disposed through the opening 108. The head 110 may further have a receiving material 130, the receiving material 130 may be located between the first pusher 142 and the second pusher 144, as shown in FIG. 8. When the blade 112 is exposed to cut the paper sheeting 12, the receiving material 130 accepts the blade 112. This allows an individual to manipulate the paper crumpling apparatus 110, such as to replace parts or fix a paper jam, or the like, with reduced chances of being injured by the blade 112. The receiving material also assists the blade 112 with cutting the paper sheeting 12 by placing additional pressure on the cutting point of the paper. Moreover, the receiving material 130 further protects the blade 112 while the machine is in use, increasing the lifespan of the blade 112.

FIGS. 6-7 further illustrate the head 110 having the first pusher 142 and the second pusher 144 extending therefrom. When the head 110 moves downwardly, the first pusher 142 and the second pusher 144 make contact with the first section 138 and the second section 140 of the bottom plate 136. The first section 138 and the second section 140 of the bottom plate 136 may be made from either a resilient material or supported through the use of springs. The resilient material may be sponge-like or some other material known in the art that when pressed will compress sufficiently to expose the blade 112 contained between the first section 138 and the second section 140. Similarly, if the first section 138 and the second section 140 are spring loaded, the spring (not shown) should provide an amount of tension such that when the first pusher 138 and the second pusher 140 are brought into contact with the first section 138 and the second section 140 and apply pressure thereto, the spring will compress and expose the blade 112 located between the first section 138 and the second section 140. The blade 112 should be strong enough to fully cut the paper sheeting 12 when the paper sheeting 12 is crumpled. The blade 112 may further have a plurality of sharpened teeth allowing easy cutting of the paper sheeting disposed beneath.

Figure 9:
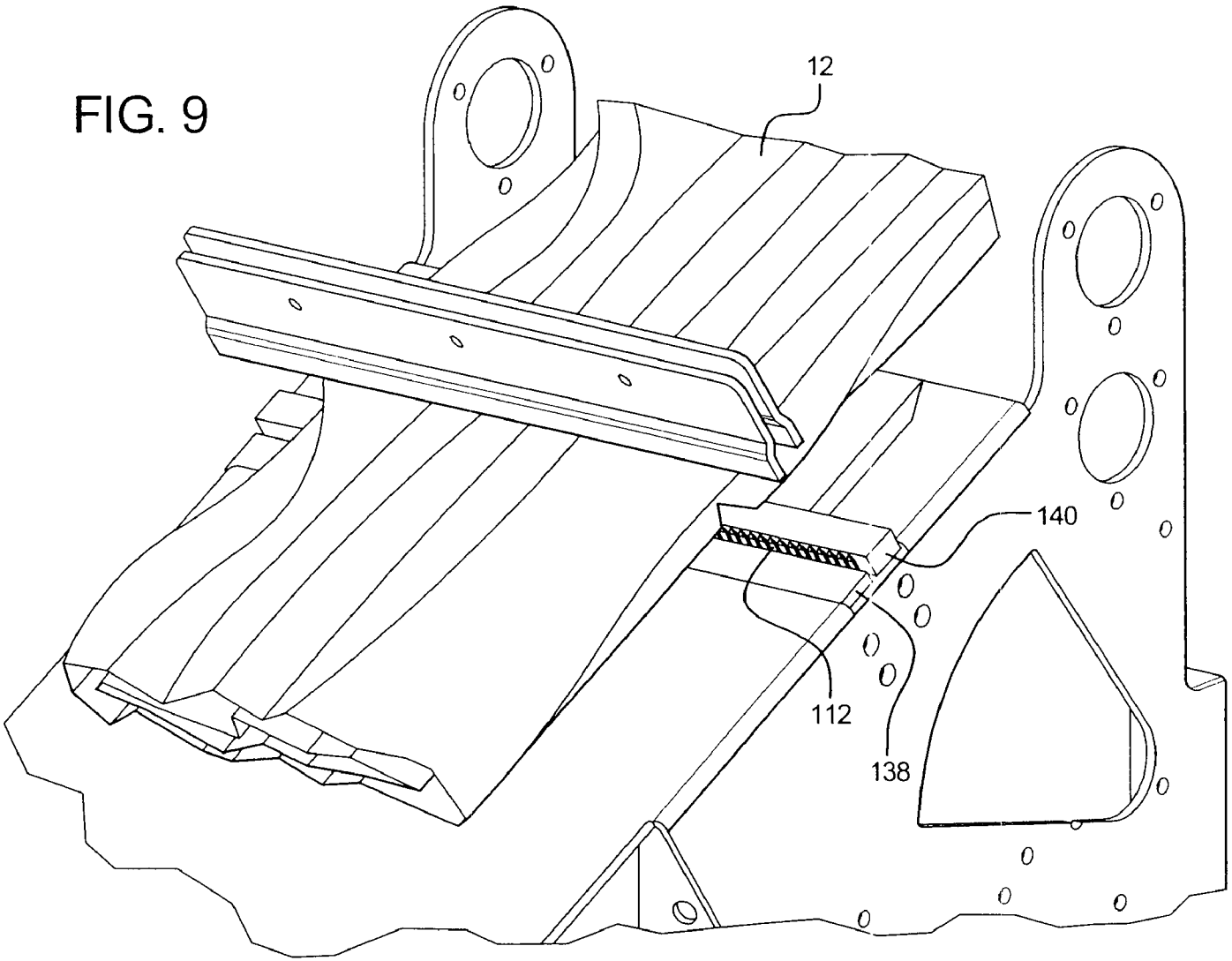
FIG. 9 illustrates an elevated perspective view of a cutting mechanism for the paper sheeting in an embodiment of the present invention.

FIGS. 8-9 illustrate a side view of the cutting mechanism of the paper crumpling machine 10. As shown, the first section 138 and the second section 140 of the bottom plate 136 are at different elevations with respect to each other. The first pusher 142 and the second pusher 144 are at different lengths to accommodate the different elevations of the first section 138 and the second section 140 of the bottom plate 136. When the first pusher 142 and the second pusher 144 are moved in a downwardly direction, the paper sheeting 12 is pressed between the first pusher 142 and the first section 138 of the bottom plate 136 and further between the second pusher 144 and the second section 140 of the bottom plate 136. The different elevations of the first section 138 and the second section 140 of the bottom plate 136, cause the paper sheeting 12 to be crimped, thereby compressing the end of the paper sheeting 12 that is cut or torn, allowing the paper 12 to be bound tightly preventing the paper sheeting 12 from unraveling or flattening out after the cut or tear has been made. The different elevations of the first section 138 and the second section 140 of the bottom plate 136 also facilitate the section of cut or torn paper sheeting 12 falling away from the cutting mechanism following the cutting or tearing.

Figure 10:
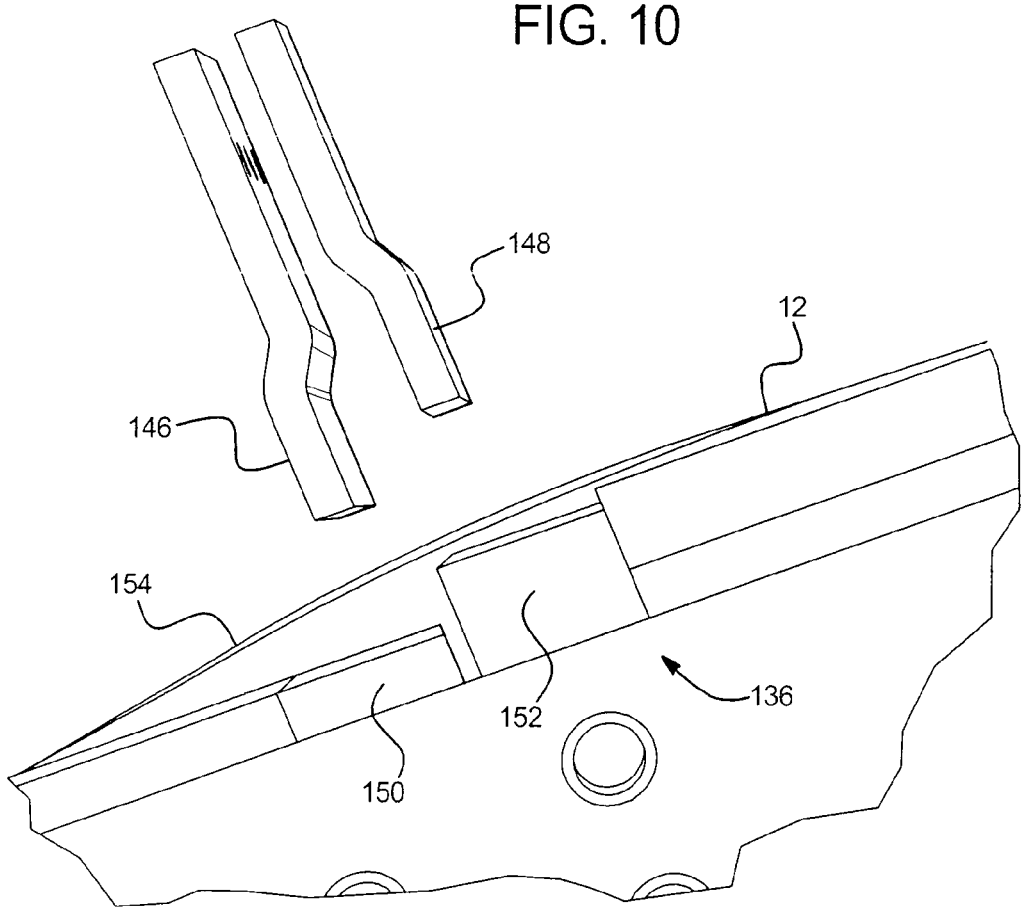
FIG. 10 illustrates a side view of a tearing mechanism for the paper sheeting in an embodiment of the present invention.

In another embodiment, illustrated in FIG. 10, the head (not shown) moves downwardly, causing a first pusher 146 and a second pusher 148 to clamp the paper sheeting 12 between the first pusher 146, the second pusher 148 and the first section 150 and the second section 152 of the bottom plate 136, as shown in FIG. 10. The paper sheeting 12 has perforations 154 that may be located at or near the outside edge of the first pusher 146. When the paper sheeting 12 is clamped, tension may be applied to the paper sheeting 12 by either an additional mechanism or a user, causing the paper sheeting 12 to tear along the perforation 154. In this embodiment, the blade 112 is not present, thereby allowing for safer operation and for ease of use.

Figure 11:
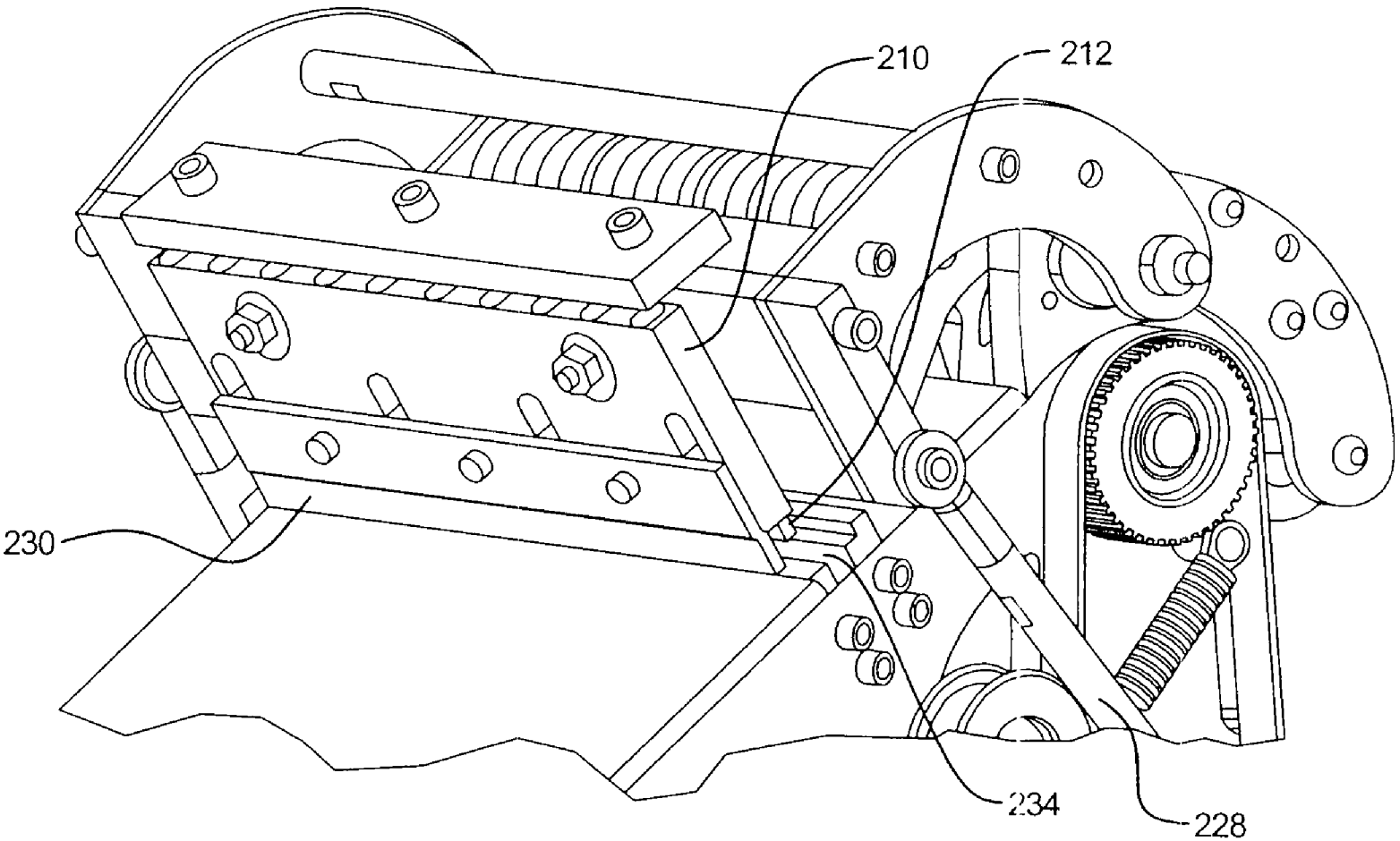
FIG. 11 illustrates a side perspective view of a cutting mechanism for the paper sheeting in an embodiment of the present invention.

In a further embodiment, illustrated in FIG. 11, a blade 212 is attached to a head 210 that may traverse in a downward direction when the head 210 moves in the downward direction, caused by the pulling of an arm 228. The blade 212 may cut the paper sheeting. A slot 234 may be contained under the blade 212 for accepting the blade 212 when the blade 212 is fully extended. This allows the blade 212 to fully pierce and cut the paper sheeting 12 that may be positioned beneath the blade 212. The blade 212 should be strong enough and sharp enough to fully cut the paper sheeting 12 when the paper sheeting 12 is crumpled. The blade 212 may further have a plurality of sharpened teeth allowing easy cutting of the paper sheeting disposed beneath.

The head 210 may further have a safety sleeve 230 that is blocked from moving when the head 210 and the blade 212 move downwardly. The safety sleeve 230 generally covers the blade 212 when the blade 212 is in the upward position, but allows the blade 212 to be exposed when the blade 212 moves downwardly. This allows an individual to manipulate the paper crumpling apparatus 10, such as to replace parts or fix a paper jam, of the like, with reduced chance of being injured by the blade 212. Moreover, the safety sleeve 230 further protects the blade 212, increasing the lifespan of the blade 212.

Figure 12:
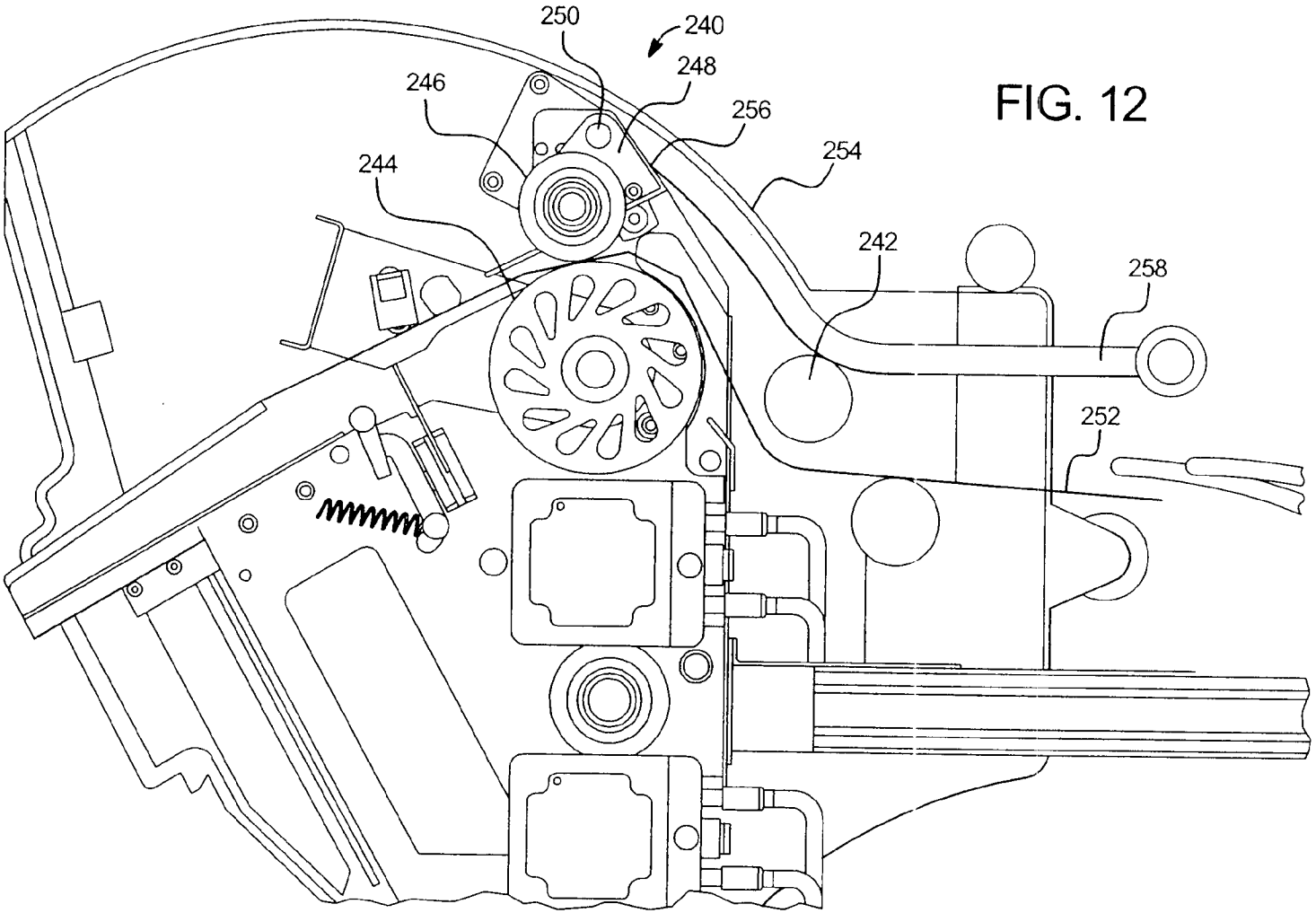
FIG. 12 illustrates a side cut-away view of a cutting mechanism in an embodiment of the present invention, during normal operation.
Figure 13:
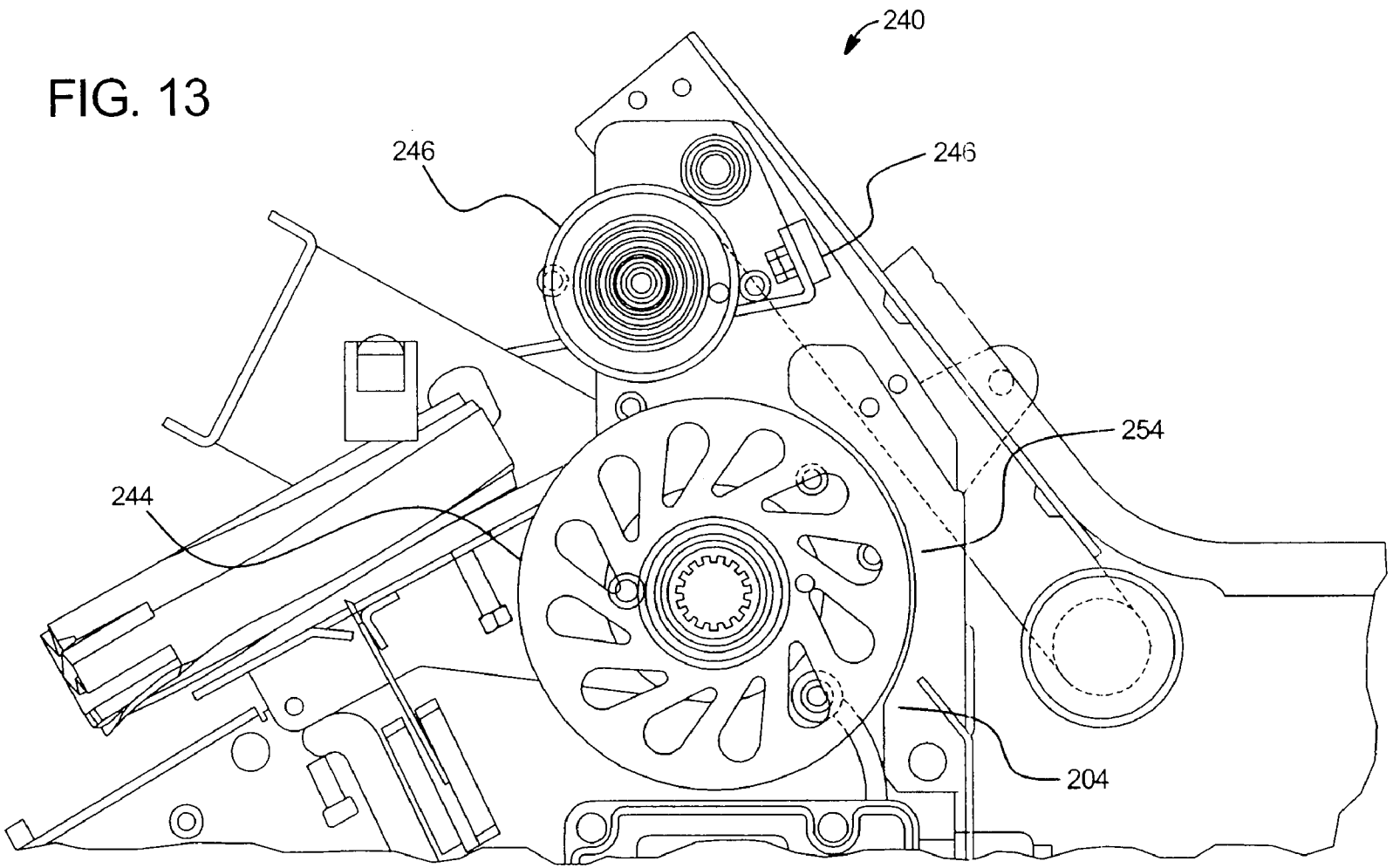
FIG. 13 illustrates a side cut-away view of an embodiment of the present invention, during an overload condition.

In a further embodiment, a crumpling apparatus with a magnetic engagement/door mechanism is shown in FIGS. 12-13. In FIG. 12, the paper crumpling apparatus comprises a crumpling zone 240 having a guide roller 242, drive roller 244, and pinch roller 246, which help guide paper sheeting 252 through the crumpling zone 240. As in previous embodiments, any number of rollers may be used, extending across some or all of the width of the paper sheeting 252 traveling through the machine.

Pinch roller 246 is mounted on bracket 248. Bracket 248 connects to pivot shaft 250, which is also connected to door 254. The connection of bracket 248 and door 254 to pivot shaft 250 allows, under certain conditions, door 254 and bracket 248 to pivot relative to one another around the axis of pivot shaft 250. During normal operation the crumpling apparatus in this embodiment, bracket 248 is held to the underside of door 254 by means of a magnet 256 or similar attachment device. Multiple magnets may also be used, and the size, strength, and number of magnet(s) may vary depending on the strength of the attraction desired between the bracket 248 and the door 254. In addition, while the present embodiment describes one or more magnets, other like means may be utilized to hold the door 254 to the bracket 248, such as clips, hooks, hook-and-loop mechanisms (commonly referred to as VELCRO®), adhesives, or other like means.

The door 254 may have a handle 258 and, as describe above, may rotate around pivot shaft 250. When access to the crumpling zone 240 is desired by a user, technician, or other individual desiring access, the handle 258 may be lifted, causing the door 254 to rotate up and away from the crumpling zone 240, thereby allowing an individual to gain access to the crumpling zone. Pulling the handle 258 upwards disengages door 254 from bracket 248 by breaking the magnetic attraction of the magnet 256 to the door 254.

When door 254 is held by magnet 256 to bracket 248, door 254 is prevented from pivoting relative to bracket 248. In this configuration, guide roller 242 and pinch roller 246 may be considered rigidly attached to one another, because both are attached to the combination of door 254 and bracket 248 held together by magnet 256. This configuration allows pinch roller 246 and guide roller 242 to act in concert to provide traction to guide paper sheeting 252 as it traverses through the crumpling apparatus, so that paper sheeting 252 therein is crushed to form folds and/or pleats. The pinch roller 246 and guide roller 242 operate similarly to rollers described in previous embodiments.

The attraction between magnet 256 and door 254 also allows the pinch roller 242 to tighten against paper sheeting 252 as material tension increases. This may occur, for example, when paper sheeting 252 is fed from a new roll, when paper sheeting 252 traverses the apparatus at accelerating speed, or when required by the material properties of the particular paper feed stock.

As in previous embodiments, the guide roller 242 and the pinch roller 246 are interconnected via the pivot shaft 250. As tension increases on the guide roller 242, such as when the paper sheeting traverses the apparatus at accelerating speed, the increased tension on the guide roller 242 may cause it to pivot upwards, thereby causing a corresponding downward pivot of the pinch roller 246 against the paper sheeting 252, thereby increasing the traction of the pinch roller 246 and the paper sheeting 252. In an alternate embodiment, magnets or other like connecting mechanisms may not be used, and the pivot shaft may be tensioned, thereby providing the requisite downward force of the pinch roller 246 against the paper sheeting 252.

FIG. 13 illustrates paper crumpling apparatus 240 in an "overload" condition, in which pinch roller 206 is lifted away from drive roller 244 and disengaged from the paper sheeting (not shown). Disengagement may occur when paper sheeting jams in the area between the drive roller 244 and pinch roller 246. If the accumulated material exerts an upward lifting force on pinch roller 246 which exceeds the force of magnet 256, then pinch roller 246 may be lifted, causing magnet 256 to disengage from door 254, and in turn, causing bracket 248 to pivot relative to door 254. When this occurs, guide roller 242 and pinch roller 246 no longer act in concert to apply tension to paper sheeting 252. Although drive roller 244 may continue to spin, disengagement of the traction provided by guide roller 242 and pinch roller 246 may prevent paper sheeting from continuing to be fed through the apparatus.

In the event that sufficient paper becomes trapped in the area of pinch roller 246, the present embodiment provides a mechanism for pinch roller 246 to automatically disengage from the paper sheeting, preventing further backup. This may conserve paper sheeting stock and prevent possible damage to components of the paper crumpling apparatus. In addition, if the handle 258 is lifted (shown in FIG. 13) to open door 254, this can cause magnet 256 to disengage from door 254, and in turn, pinch roller 246 to disengage from the paper sheeting. This stops movement of paper sheeting through the apparatus when the door 254 is opened and the inner components the apparatus are exposed, to allow the operator to more safely examine the apparatus. Therefore, an operator of the apparatus may automatically disengage the pinch roller 246 from the paper sheeting 252, if necessary, merely by lifting the handle 258.

Figure 14:
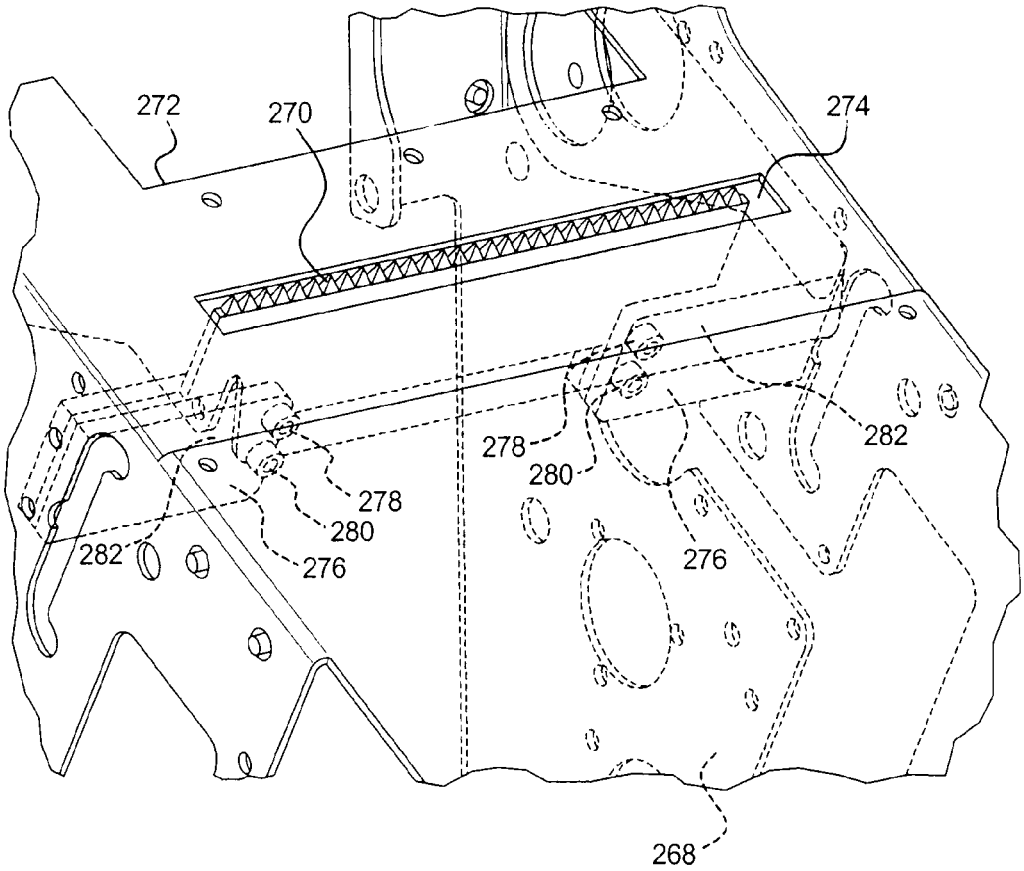
FIG. 14 illustrates a cut-away perspective view of a cutting mechanism for the paper sheeting in an embodiment of the present invention.

FIG. 14 illustrates a paper cutting blade mounted in a chassis 268 of a paper crumpling apparatus. Blade 270 is partially enclosed by platen 272. Platen 272 contains a slot 274 which allows the teeth of the blade 270 to be exposed to the paper sheeting (not shown) as it progresses through the crumpling apparatus. As shown in this embodiment, slot 274 can be wider than the width of blade 270. As further described below, blade 270 may be mounted such that it is not held completely rigid within slot 274. This configuration allows blade 270 to move or wobble back-and-forth within the width of slot 274. This is advantageous in some circumstances because allowing blade 270 to wobble within slot 274 permits the teeth and/or sharp edge of blade 270 to contact the paper sheeting at slightly different angles of contact. Altering the angle of contact may enhance the effectiveness of blade 270 at cutting the paper sheeting, depending upon the physical properties of the particular paper sheeting, the configuration and wear on blade 270, and other factors. Thus permitting blade 270 to wobble within slot 274 helps blade 270 naturally find the optimal angle of contact to the paper, within the range of motion that is permitted by both the width of slot 274 and the rigidity with which blade 270 is attached to mounting blocks 276.

As shown in FIG. 14, Blade 270 may be attached to mounting blocks 276. In the embodiment shown, two mounting blocks 276 help secure blade 270 at either end. Each mounting block 276 contains a slot or groove within which blade 270 is fitted. Each mounting block 276 on either side of the blade 270 need not be one-piece, but instead may comprise multiple blocks on either ends and sides of blade 270. Mounting blocks 276 can be held together by screws or like fastening devices, or even more permanently affixed to adjacent components of the crumpling apparatus, such as chassis 268. Alternatively, one or more mounting blocks can run along the entire length of blade 270, rather than just the ends, if added support is needed. In addition, the width of the slot or groove in mounting blocks 276 and/or the width of slot 274 may be adjusted to accommodate blades of differing width and/or to adjust the desired wobble of blade 270.

In the embodiment shown, blade 270 is secured within mounting blocks 276 by upper screws 278 and lower screws 280. Any number of screws or like fastening devices may be used, depending upon the desired blade 270 chosen, as well as the preferred mounting configuration. Optionally, mounting blocks 276 may contain any number of additional holes 282, which would allow the machine operator to use cutting blades of different length and/or blades which contain differently spaced mounting holes. The additional holes avoid the necessity of changing other components within the apparatus to accommodate a different blade.

Figure 15:
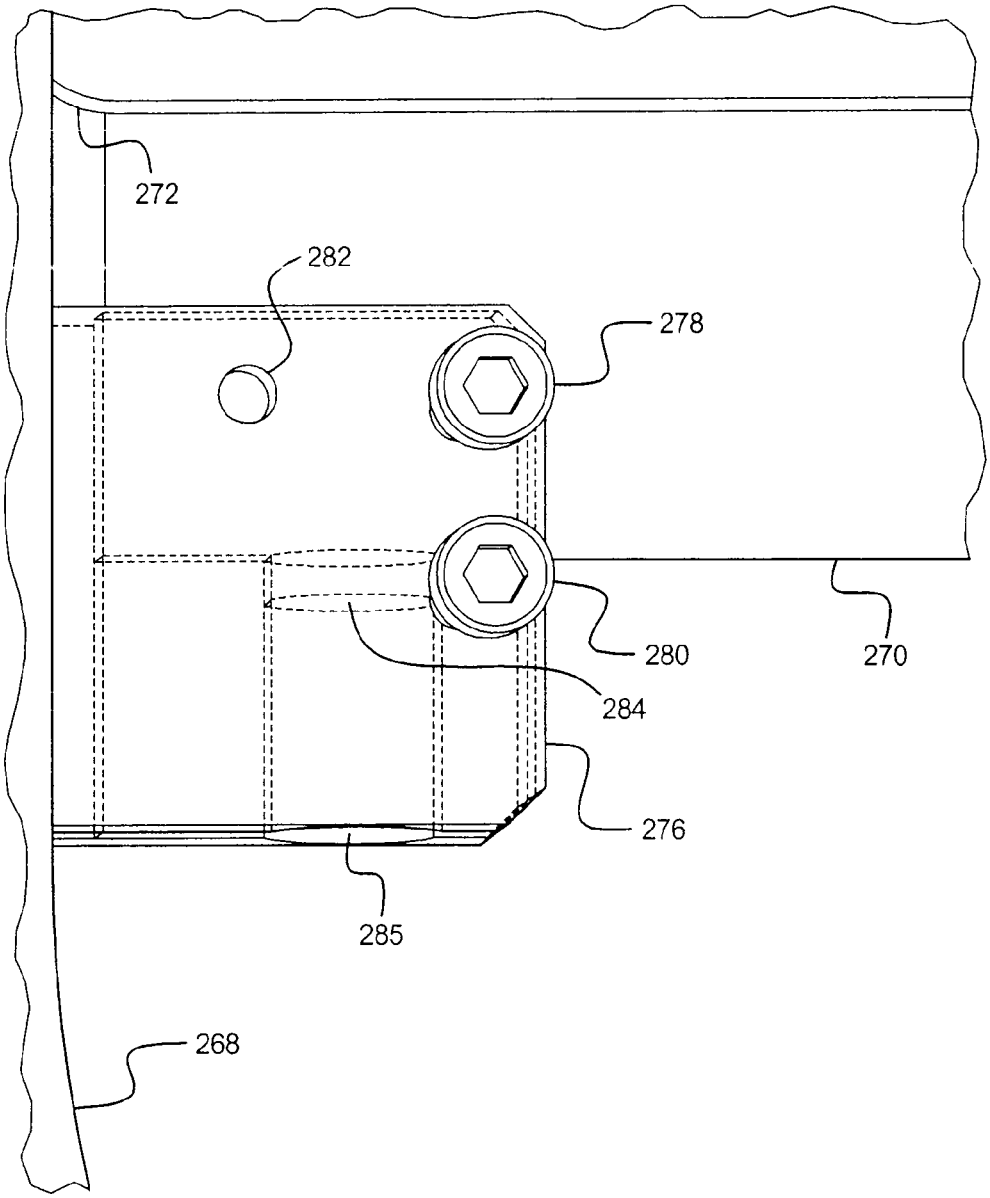
FIG. 15 illustrates a close-up view of the blade mounting system for the mechanism shown in FIG. 14.

FIG. 15 shows a closer view of blade 270 mounted in a configuration according to the embodiment shown in FIG. 14. Lower screw 280 serves as a lower support for blade 270. Support may be provided, however, from means other than a screw, such as a slot within mounting block 276, or other component. Thus, separate upper and lower screws are not necessary. In addition, multiple extra holes (not shown) can be made in mounting block 276, which would allow a machine operator to adjust the height of the lower support as necessary in order to adjust the height of the blade and/or in order to accommodate blades of differing height.

As shown, upper screw 278 extends through mounting block 276 and blade 270, to the backside of blade 270 and the other end of the mounting block 276. The hole made in blade 270 to accommodate upper screw 278 may be made larger than strictly necessary to accommodate upper screw 278. Creating a larger hole in blade 270 further facilitates the ability of blade 270 to wobble or move within slot 274 of FIG. 14, because then upper screw 278 is not attached to blade 270 with complete rigidity.

Creating a larger than necessary hole through blade 270 to accommodate screw 278 may have the effect of allowing blade 270 to wobble slightly upwards in FIG. 15. A magnet 284 may be placed in mounting block 276, thereby keeping the bottom of blade 270 securely affixed to the lower support (such as lower screw 280). Magnet 284 can be installed or removed through slot 285.

The arrangement shown in FIG. 15 thus keeps blade 270 affixed to the lower support, preventing blade 270 from moving upward, but it also allows blade 270 to beneficially wobble from side-to-side within slot 274 of FIG. 14. To secure blade 270, the size and strength of magnet 284 may be varied according to need, and multiple magnets may be employed. Alternatively, a different fastening mechanism altogether may be used to keep blade 270 affixed to a lower support, such as a VELCRO™ hook and loop fastener, adhesives, or similar means.

Figure 16:
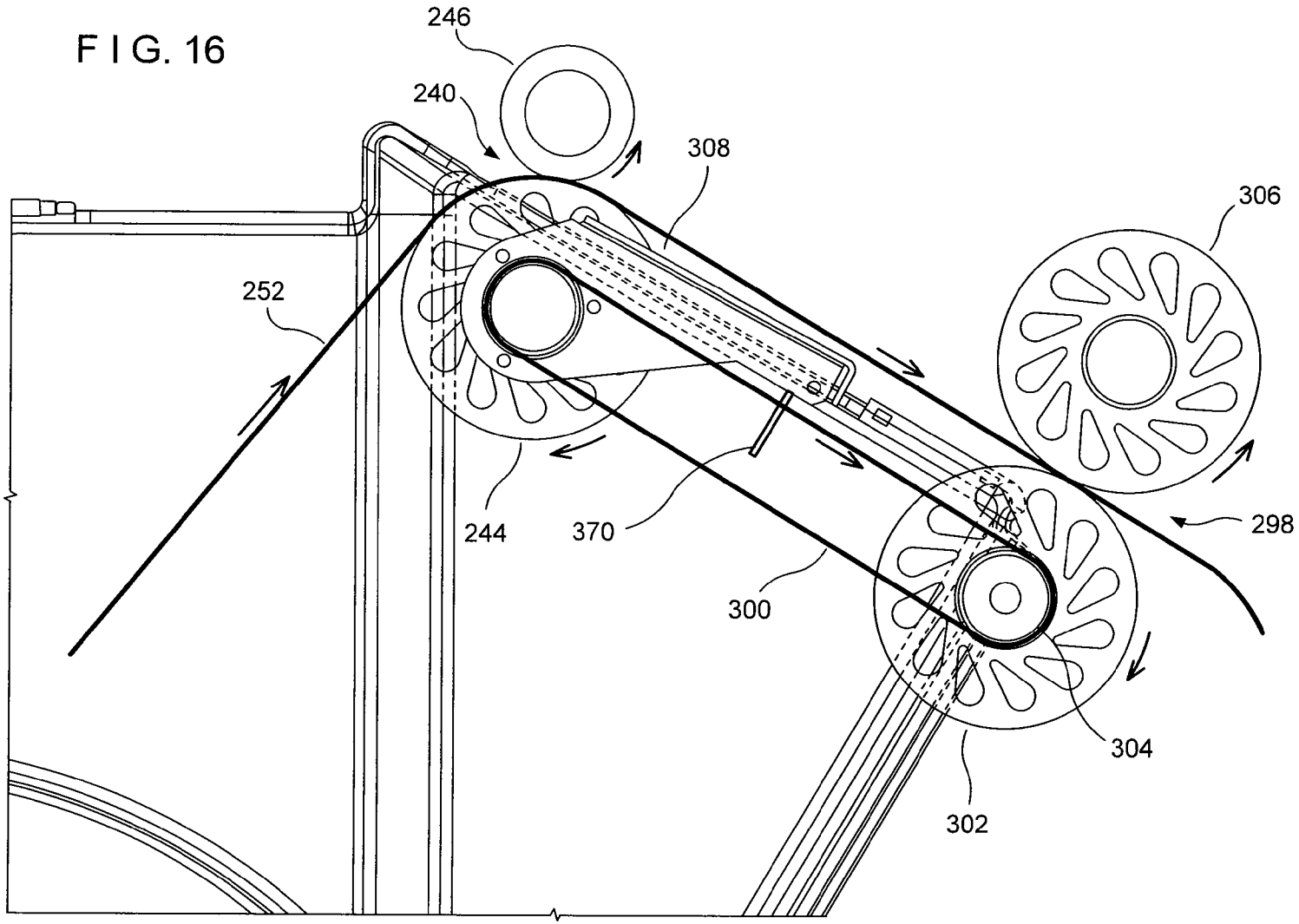
FIG. 16 illustrates a side view of a paper crumpling apparatus with an exit zone in an embodiment of the present invention.

FIG. 16 shows a side view of a paper crumpling apparatus with an exit zone 298, in an embodiment of the present invention. An apparatus in accordance with this embodiment may comprise a crumpling zone 240 having a drive roller 244 and a pinch roller 246 which help guide the paper sheeting 252 through the crumpling zone 240. As in previous embodiments, any number of rollers may be employed, across some or all of the width of the apparatus. Drive roller 244 may be driven directly by a motor or by a gearbox mechanism (not shown).

Exit zone 298 comprises a first exit roller 302, which may be connected to drive roller 244 by a belt 300. Belt 300 could also be a chain or similar mechanism suitable for driving rotation of first exit roller 302. Alternatively, first exit roller 302 may have its own independent drive mechanism. First exit roller 302 may have a clutch 304, which allows for first exit roller 302 to disengage from the rotational force provided by belt 300 and for first exit roller 302 to freely spin on its own. Clutch 304 can be "one-way," allowing first exit roller 302 to freely rotate only in one direction. Allowing first exit roller 302 to disengage from the rotation provided by belt 300 allows for easier and safer clearing of paper that may be built up or jammed in the crumpling apparatus. When no rotational force is being provided to first exit roller 302, clutch 304 still allows for rotation of first exit roller 302, so that an operator may remove, any paper remaining in exit zone 298.

In addition, exit zone 298 ideally comprises a second exit roller 306 to help guide the crumpled and cut paper into a container (not shown). The use of a pair of exit rollers helps guide the leading edge of the paper through the exit of the apparatus. However, in place of exit roller 306, a frame, plate, or other structure may be used which, in conjunction with first exit roller 302, channels the paper to exit the crumpling apparatus.

As with the rollers in the crumpling zone, first exit roller 302 and second exit roller 306 may be comprised of any number of rollers, across some or all of the width of the entire paper crumpling apparatus. Further, first exit roller 302 and second exit roller 304 may be configured with optional features similar to the drive roller configurations discussed in previous embodiments of the present invention.

In FIG. 16, the embodiment shown includes a protective plate 308 that is rotatably attached to the axis of drive roller 244. The protective plate 308 allows blade 270 to be exposed to the paper sheeting as it progresses through the crumpling apparatus. Although protective plate 308 may be attached to any portion of the crumpling apparatus, attaching protective plate 308 to the axis of drive roller 244 provides an expedient way to allow protective plate 308 to move and to thereby expose blade 270 to the paper sheeting. This design may be combined with the other descriptions of the cutting mechanism disclosed herein, such as that shown in FIG. 14.

The paper crumpling apparatus, as described herein, allows a length of crumpled paper sheeting to eject from the paper crumpling apparatus, to be utilized in packing boxes or other containers having products contained therein, or for any other use apparent to one having ordinary skill in the art.

The present invention has been described above with reference to exemplary embodiments. However, those skilled in the art having read this disclosure will recognize that changes and modifications may be made to the exemplary embodiments without departing from the scope of the present invention.

We claim:

1. An apparatus for converting sheeting material for making a cushioning product, comprising:

a first roller connected to a drive mechanism;

a second roller disposed adjacent said first roller wherein said sheeting material travels between the first roller and the second roller and further wherein the second roller pushes said sheeting material against said first roller to engage the sheeting material with the first roller; and a magnet having a magnetic force for holding said second roller adjacent said first roller, the magnet and second roller being configured for allowing the second roller to automatically move away from said first roller to disengage the sheeting material from the first roller when the sheeting material overloads between the first roller and second roller and creates a force that exceeds a magnetic force of the magnet.

2. The apparatus of claim 1, wherein the first and second rollers are associated to engage the sheeting material and convert the sheeting material for making the cushioning product.

3. The apparatus of claim 1, further comprising a handle which assists in moving said second roller away from said first roller.

4. The apparatus of claim 1, wherein said second roller is configured for changing the tension applied to the sheeting material as the sheeting material travels between the first roller and the second roller.

5. The apparatus of claim 1, further comprising a first arm attached to a pivot point wherein said second roller is attached to said arm, wherein said second roller is magnetically held adjacent said first roller.

6. The apparatus of claim 5, further comprising a second arm attached to said pivot point wherein said first arm is magnetically held to said second arm for holding said second roller adjacent said first roller.

7. The apparatus of claim 5, further comprising:

a pivotable door attached to said pivot point and a third roller attached to said pivotable door, said first arm magnetically held to said pivotable door for holding said second roller adjacent said first roller, wherein said sheeting material traverses under said third roller causing upward pressure on said third roller; and said pivotable door interconnected with said first arm at said pivot point, wherein upward pressure on said third roller causes tension applied against said first roller by said second roller to increase.

8. The apparatus of claim 1, further comprising a neck at disposed for feeding the sheeting material to the first and second rollers and configured reducing the lateral width of sheeting material fed to the first and second rollers.

9. The apparatus of claim 1, wherein the feeder comprises a guide having a plurality of longitudinally disposed tines for guiding said sheeting material and disposing a wave pattern in said sheeting material, wherein the tines are curved longitudinally.

10. The apparatus of claim 9, wherein the tines are arranged to define an imaginary surface disposed over said tines, over which the sheeting material is directed, that is curved laterally and longitudinally.

11. The apparatus of claim 1, wherein:

the apparatus is a crumpling apparatus configured for crumpling the sheeting material for making the cushioning product;

the first and second rollers are disposed in a crumpling zone configured to crumple the sheeting material, the first roller comprising a drive roller, and the second roller comprising a pinch roller, the drive roller and pinch roller associated for cooperatively pulling and crumpling the sheeting material.

12. The apparatus of claim 11, further comprising a cutting mechanism configured for cutting the crumpled sheeting material.

* * * * *